US011240884B2

(12) United States Patent
Butin et al.

(10) Patent No.: US 11,240,884 B2
(45) Date of Patent: Feb. 1, 2022

(54) INDUCTIVE HEATING DEVICE, AEROSOL-GENERATING SYSTEM COMPRISING AN INDUCTIVE HEATING DEVICE AND METHOD OF OPERATING THE SAME

(71) Applicant: Philip Morris Products S.A., Neuchatel (CH)

(72) Inventors: Yannick Butin, Marin-Epagnier (CH); Oleg Fursa, Gempenach (CH); Oleg Mironov, Cudrefin (CH); Benoit Sottas, La Tour-de-Treme (CH)

(73) Assignee: Philip Morris Products S.A., Neuchatel (CH)

( * ) Notice: Subject to any disclaimer, the term of this patent is extended or adjusted under 35 U.S.C. 154(b) by 109 days.

(21) Appl. No.: 16/500,254

(22) PCT Filed: Jun. 29, 2018

(86) PCT No.: PCT/EP2018/067716
§ 371 (c)(1),
(2) Date: Oct. 2, 2019

(87) PCT Pub. No.: WO2019/002613
PCT Pub. Date: Jan. 3, 2019

(65) Prior Publication Data

US 2021/0145071 A1 May 20, 2021

(30) Foreign Application Priority Data

Jun. 30, 2017 (EP) ..... 17179190

(51) Int. Cl.
*A24F 13/00* (2006.01)
*H05B 6/06* (2006.01)
(Continued)

(52) U.S. Cl.
CPC ..... *H05B 6/06* (2013.01); *A24D 1/20* (2020.01); *A24F 40/50* (2020.01); *A24F 40/53* (2020.01);
(Continued)

(58) Field of Classification Search
CPC ..... A24F 47/00
(Continued)

(56) References Cited

U.S. PATENT DOCUMENTS 5,613,505 A 3/1997 Campbell et al.
10,925,317 B2 * 2/2021 Smith ..... A61M 15/0023
(Continued)

FOREIGN PATENT DOCUMENTS

CN 1196160 A 10/1998
CN 1836467 A 9/2006
(Continued)

OTHER PUBLICATIONS

International Search Report and Written Opinion dated Sep. 26, 2018 in PCT/EP2018/067716 filed on Jun. 29, 2018.
(Continued)

*Primary Examiner* — Phuong K Dinh
(74) *Attorney, Agent, or Firm* — Oblon, McClelland, Maier & Neustadt, L.L.P.

(57) ABSTRACT

An inductive heating device, an aerosol-generating system, and a method of operating the device are provided. The device is configured to receive an aerosol-generating article including an aerosol-forming substrate and a susceptor, and to heat the susceptor when the article is received by the device, the device including a DC power supply; and power supply electronics configured to supply power to the inductor in a plurality of pulses separated by time intervals, for heating the susceptor when the article is received by the device, the pulses including two or more heating pulses and
(Continued)

one or more probing pulses between successive heating pulses, and to control a duration of a time interval between the successive heating pulses based on one or more measurements of the current supplied from the DC power supply in one or more of the one or more probing pulses.

17 Claims, 6 Drawing Sheets

(51) Int. Cl.

| | |
|---|---|
| ***A24F 40/50*** | (2020.01) |
| ***A24F 40/53*** | (2020.01) |
| ***A24F 40/57*** | (2020.01) |
| ***A24D 1/20*** | (2020.01) |
| *A24F 40/20* | (2020.01) |
| *A24F 40/465* | (2020.01) |

(52) U.S. Cl.
CPC ..... *A24F 40/57* (2020.01); *A24F 40/20* (2020.01); *A24F 40/465* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2014/0321837 | A1 | 10/2014 | Flick | |
| 2016/0150828 | A1 | 6/2016 | Goldstein et al. | |
| 2021/0127754 | A1* | 5/2021 | Tatsuta | H02J 7/0044 |
| 2021/0178090 | A1* | 6/2021 | Lahoud | A24F 40/10 |

FOREIGN PATENT DOCUMENTS

| | | | |
|---|---|---|---|
| CN | 1991654 | A | 7/2007 |
| CN | 103945716 | A | 7/2014 |
| CN | 104470386 | A | 3/2015 |
| CN | 204539518 | U | 8/2015 |
| CN | 204599333 | U | 9/2015 |
| CN | 105027016 | A | 11/2015 |
| CN | 105407750 | A | 3/2016 |
| CN | 106455722 | A | 2/2017 |
| GB | 2543329 | A | 4/2017 |
| RU | 2015148609 | A | 5/2017 |
| RU | 2015151873 | A | 6/2017 |
| WO | WO 95/27411 | A1 | 10/1995 |
| WO | WO 2013/060784 | A2 | 5/2013 |
| WO | WO 2015/177255 | A1 | 11/2015 |
| WO | WO 2015/177256 | A1 | 11/2015 |
| WO | WO 2015/177257 | A1 | 11/2015 |
| WO | WO 2015/177294 | A1 | 11/2016 |
| WO | WO 2018/096000 | A1 | 5/2018 |

OTHER PUBLICATIONS

Combined Chinese Office Action and Search Report dated Aug. 25, 2021 in corresponding Chinese Patent Application No. 201880038553.2 (with English translation), citing documents AL-AU therein, 12 pages.

Combined Russian Notice of Allowance and Search Report dated Oct. 20, 2021 in corresponding Russian Patent Application No. 2019139665 (with English translation), citing documents AA, AO and AP therein, 25 pages.

* cited by examiner

INDUCTIVE HEATING DEVICE, AEROSOL-GENERATING SYSTEM COMPRISING AN INDUCTIVE HEATING DEVICE AND METHOD OF OPERATING THE SAME

CROSS-REFERENCE TO RELATED APPLICATIONS

This application is a U.S. national stage application of PCT/EP2018/067716, filed on Jun. 29, 2018, which is based upon and claims the benefit of priority from European patent application no. 17179190.8, filed Jun. 30, 2017, the entire contents of each of which are incorporated herein by reference.

TECHNICAL FIELD

The present invention relates to an inductive heating device for heating an aerosol-forming substrate. The present invention also relates to an aerosol-generating system comprising such an inductive heating device. The present invention further relates to a method of operating such aerosol-generating system.

DESCRIPTION OF THE RELATED ART

Electrically operated aerosol-generating systems comprising an aerosol-generating article having an aerosol-forming substrate and an electrically operated heat source that is configured to heat the aerosol-forming substrate are known in the art. Such systems typically generate an aerosol by transferring heat from the heat source to the aerosol-forming substrate, which releases volatile compounds from the aerosol-forming substrate that become entrained in air drawn through the aerosol-generating article, cool and condense to form an aerosol that may be inhaled by a user.

Some electrically operated aerosol-generating system comprise an inductive heating device or an electrically operated aerosol-generating device having an induction source. Inductive heating devices typically comprise an induction source that is configured to be coupled to a susceptor. The induction source generates an alternating electromagnetic field that induces eddy currents in the susceptor. The induced eddy currents heat the susceptor through ohmic or resistive heating. The susceptor is further heated as a result of hysteresis losses.

Electrically operated aerosol-generating systems comprising an inductive heating device typically also comprise an aerosol-generating article having an aerosol-forming substrate and a susceptor in thermal proximity to the aerosol-forming substrate. In these systems, the induction source generates an alternating electromagnetic field that induces eddy currents in the susceptor. The induced eddy currents heat the susceptor, which in turn heats the aerosol-forming substrate. Typically, the susceptor is in direct contact with the aerosol-forming substrate and heat is transferred from the susceptor to the aerosol-forming substrate primarily by conduction. Examples of electrically operated aerosol-generating systems having inductive heating devices and aerosol-generating articles having susceptors are described in WO-A1-95/27411 and WO-A1-2015/177255.

One aim of electrically operated aerosol-generating systems is to reduce known harmful by-products of combustion and pyrolytic degradation of some aerosol-forming substrates. As such, it is desirable for these systems to monitor the temperature of the aerosol-forming substrate to ensure that the aerosol-forming substrate is not heated to a temperature at which the aerosol-forming substrate may combust.

In aerosol-generating articles having a susceptor that is in direct contact with the aerosol-forming substrate, it may be assumed that the temperature of the susceptor is representative of the temperature of the aerosol-forming substrate. Using this assumption, the temperature of the aerosol-forming substrate may be monitored by monitoring the temperature of the susceptor.

Typically, a susceptor in an aerosol-generating article that is coupled to an inductive heating deice is not directly physically connected to circuitry in the inductive heating device. As a result, it is not possible for the inductive heating device to directly monitor electrical quantities of the susceptor, such as the electrical resistance, and calculate the temperature of the susceptor from known relationships between electrical quantities and temperature.

However, there are some prior art proposals for determining the temperature of a susceptor without direct measurement of electrical quantities of the susceptor. For example, in WO-A1-2015/177255, WO-A1-2015/177256 and WO-A1-2015/177257 an electrically operated aerosol-generating system is proposed that comprises a device having a DC power supply and an inductor and circuitry configured to measure the DC voltage and current across the DC power supply to determine an apparent resistance of a susceptor coupled to the inductor. As described in the above mentioned documents, surprisingly, it has been found that the apparent resistance of a susceptor may vary with the temperature of the susceptor in a strictly monotonic relationship over certain ranges of temperature of the susceptor. The strictly monotonic relationship allows for an unambiguous determination of the temperature of the susceptor from a determination of the apparent resistance. This is because each determined value of the apparent resistance is representative of only one single value of the temperature, there is no ambiguity in the relationship. The monotonic relationship of the temperature of the susceptor and the apparent resistance allows for the determination and control of the temperature of the susceptor and thus for the determination and control of the temperature of the aerosol-forming substrate.

There exists an opportunity to improve the determination and control of the temperature of an aerosol-forming substrate in an electrically operated aerosol-generating system having an inductive heating device. In particular, there exists an opportunity to improve the interaction between an inductive heating device and an aerosol-generating article having a susceptor.

It would be desirable to provide a temperature monitoring and control function in an electrically operated aerosol-generating system comprising an inductive heating device and an aerosol-generating article having a susceptor that is straightforward to implement, reliable and inexpensive. It would also be desirable to provide a puff detection function in an aerosol-generating device comprising inductive heating means that is straightforward to implement, reliable and inexpensive.

SUMMARY

According to a first aspect of the present invention, there is provided an inductive heating device configured to receive an aerosol-generating article comprising an aerosol-forming substrate and a susceptor in thermal proximity to the aerosol-forming substrate, the inductive heating device being configured to heat the susceptor when the aerosol-generating article is received by the inductive heating device, the inductive heating device comprising: a DC power supply for providing a DC supply voltage and a current; and power supply electronics. The power supply electronics comprise: a DC/AC converter connected to the DC power supply; and an inductor connected to the DC/AC converter and arranged to inductively couple to a susceptor of an aerosol-generating article when an aerosol-generating article is received by the inductive heating device. The power supply electronics are configured to: supply power to the inductor from the DC power supply, via the DC/AC converter, for heating the susceptor of the aerosol-generating article when the aerosol-generating article is received by the inductive heating device, the supply of power being provided in a plurality of pulses separated by time intervals, the pulses comprising two or more heating pulses and one or more probing pulses between successive heating pulses. The power supply electronics are further configured to control the duration of the time interval between successive heating pulses based on one or more measurements of the current supplied from the DC power supply in one or more of the one or more probing pulses.

BRIEF DESCRIPTION OF THE DRAWINGS

Specific embodiments will now be described with reference to the figures, in which.

DETAILED DESCRIPTION

Figure 1:
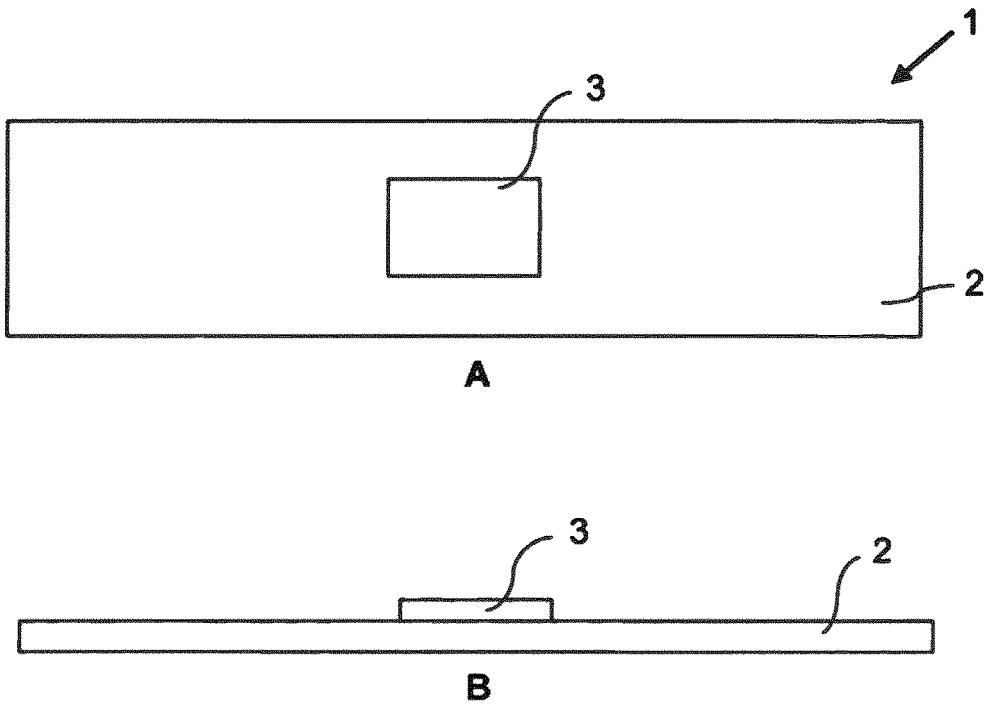
FIG. 1A is a plan view of a susceptor for use in an aerosol-generating article of an aerosol-generating system according to an embodiment of the present invention.
FIG. 1B is a side view of the susceptor of FIG. 1A.

Supplying power to the inductor in a plurality of pulses, separated by time intervals, enables the power supply electronics to provide fine control to the heating of a susceptor and aerosol-forming substrate in an aerosol-generating article received by the inductive heating device.

During each pulse of power supplied from the DC power supply to the inductor, the inductor generates an AC electromagnetic field that induces eddy currents in a susceptor of an aerosol-generating article coupled to the inductor. The eddy currents in the susceptor heat the susceptor, which in turn heats the aerosol-forming substrate of the article.

During the time intervals between successive pulses of power from the DC power supply, the supply of power from the DC power supply to the inductor is interrupted. As such, the inductor either does not generate an AC electromagnetic field or generates an AC electromagnetic field with a reduced field strength. Thus, during the time intervals between successive pulses of power from the DC power supply to the inductor, the susceptor coupled to the inductor is not heated or is heated less by induced eddy currents and is provided with an opportunity to cool.

The term 'interrupt' is used herein to cover embodiments in which the supply of DC power from the DC power supply is stopped or reduced such that effectively no alternating electromagnetic field is generated by the inductor. Similarly, the term 'resume' is used herein to cover embodiments in which the supply of power from the DC power supply is started or increased such that an alternating electromagnetic field is generated by the inductor that is sufficient to cause heating of a susceptor coupled to the inductor.

The term 'successive' is used herein to refer to consecutive, adjacent or neighbouring values in a series or sequence.

The power supply electronics of the inductive heating device of the present invention are configured to supply power to the inductor from the DC power supply in a series or sequence of heating pulses separated by time intervals. During the time intervals between successive heating pulses, the power supply electronics are configured to supply power to the inductor from the DC power supply in one or more probing pulses. Where a series of two or more probing pulses are provided between successive heating pulses, the probing pulses are separated by probing pulse time intervals.

The heating pulses are generally intended to raise or maintain the temperature of a susceptor coupled to the inductor, as described in more detail later on. The time intervals between the heating pulses, in which the supply of power to the inductor is interrupted, are intended to allow the susceptor to cool. Such heating and cooling cycles may enable the temperature of the susceptor to be maintained in a desired temperature range, such as an optimum temperature range for generation of aerosol from an aerosol-forming substrate of an aerosol-generating article received by the inductive heating device.

The probing pulses supplied to the inductor in the time intervals between successive heating pulses are intended to provide an indirect indication of the temperature of the susceptor coupled to the inductor, as the susceptor cools. The probing pulses are intended to indirectly monitor the temperature of a susceptor coupled to the inductor by measuring the current supplied to the inductor from the DC power supply. The probing pulses are not intended to substantially raise the temperature of a susceptor coupled to the inductor. As such, the duration of the probing pulses is typically less than the duration of the heating pulses. Furthermore, where a series of two or more probing pulses are provided between successive heating pulses, the duration of the probing pulse time intervals (i.e. the time intervals between the probing pulses) is typically longer than the duration of the probing pulses.

Providing relatively short probing pulses, compared to the duration of the heating pulses, and providing relatively long probing pulse time intervals between successive probing pulses, compared to the duration of the probing pulses, ensures that the average power supplied to the inductor over the time interval between successive heating pulses is relatively low compared to the power supplied to the inductor over each heating pulse. As such, a susceptor coupled to the inductor may be allowed to cool in the time interval between the heating pulses despite the presence of the probing pulses.

Monitoring the temperature of a susceptor coupled to the inductor during the time intervals between the heating pulses may enable particularly fine control over the temperature of a susceptor coupled to the inductor. This may enable the power supply electronics to react quickly to rapid and unexpected changes in temperature.

Controlling the duration of the time periods between successive heating pulses based on measurements of current in probing pulses supplied to the inductor in the time intervals between successive heating pulses may provide several advantages over the prior art devices, which will be described in detail below.

The power supply electronics are particularly configured to control the duration of the time intervals between successive heating pulses based on measurements of the current supplied from the DC power supply in one or more of the one or more probing pulses following a heating pulse. As explained in the prior art documents mentioned above, the current supplied from the DC power supply has been found to relate to the temperature and the apparent resistance of a susceptor coupled to the inductor. Thus, the power supply electronics of the present invention are configured to control the duration of the time intervals between successive heating pulses of power supplied by the DC power supply based indirectly on the temperature of a susceptor coupled to the inductor. The current measured for each probing pulse between the successive heating pulses provides an indirect measure of the temperature of the susceptor coupled to the inductor.

By controlling the duration of the time intervals in between successive heating pulses based on the temperature of the susceptor, the inductive heating device of the present invention may compensate for temperature fluctuations in a susceptor of an aerosol-generating article coupled to the inductor during a heating cycle. For example, the inductive heating device of the present invention may be configured to increase the duration of the time intervals between successive pulses if the temperature of the susceptor coupled to the inductor is determined to reach or be raised above a maximum threshold and may be configured to reduce the duration of the time intervals between successive pulses if the temperature of the susceptor coupled to the inductor appears to reach or drop below a minimum threshold.

The inductive heating device of the present invention may provide an improved heating of the aerosol-forming substrate of an aerosol-generating article received by the inductive heating device, compared to other known inductive heating devices. The inductive heating device of the present invention may further provide improved aerosol generation and an improved user experience compared to the inductive heating devices of the prior art.

Certain aerosol-forming substrates may generate a satisfactory or an acceptable aerosol when heated in a narrow temperature range only. As such, these aerosol-forming substrates may not be suitable for use with inductive heating devices that do not enable fine or close control of the heating of a susceptor coupled to the inductor. The inductive heating device of the present invention provides improved, fine or close control of heating of a susceptor coupled to the inductor and may enable the inductive heating device of the present invention to be used with aerosol-generating articles comprising such aerosol-forming substrates.

Some aerosol-forming substrates may generate an acceptable aerosol within a particular temperature range only, such as between about 200° C. and about 240° C. Thus, in some embodiments, the inductive heating device may be configured to maintain the temperature of a susceptor coupled to the inductor at or around a particular temperature or within a particular range of temperatures.

As used herein, the term 'inductive heating device is used to describe a device comprising an induction source that generates an alternating electromagnetic field. The induction source may couple to and interacts with a susceptor. The alternating magnetic field of the induction source may generate eddy currents in a susceptor which may heat the susceptor through resistive heating. The susceptor may also be further heated as a result of hysteresis losses.

As used herein, the term 'aerosol-generating device' or 'electrically operated aerosol-generating device' is used to describe a device that interacts with an aerosol-generating article having an aerosol-forming substrate to generate an aerosol. The aerosol-generating device may be a device that interacts with an aerosol-generating article to generate an aerosol that is directly inhalable into a user's lungs thorough the user's mouth. The aerosol-generating device may be a holder for an aerosol-generating article. The aerosol-generating device may be an inductive heating device and may comprise an induction source.

As used herein, the term 'aerosol-generating article' is used to describe an article that comprises an aerosol-forming substrate. In particular, as used herein in relation to the present invention, the term 'aerosol-generating article' is used to mean an article that comprises an aerosol-forming substrate and a susceptor in thermal communication with the aerosol-forming substrate.

An aerosol-generating article may be designed to engage with an electrically operated aerosol-generating device comprising an induction heating source. The induction heating source, or inductor, may generate a fluctuating electromagnetic field for heating the susceptor when the aerosol-generating article is located within the fluctuating electromagnetic field. In use, the aerosol-generating article may engage with the electrically operated aerosol-generating device such that the susceptor is located within the fluctuating electromagnetic field generated by the inductor.

As used herein, the term 'aerosol-forming substrate' is used to describe a substrate capable of releasing, upon heating, volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the term 'susceptor' is used to describe materials that can convert electromagnetic energy into heat. When located within a fluctuating electromagnetic field, eddy currents induced in the susceptor cause heating of the susceptor. Furthermore, magnetic hysteresis losses within the susceptor cause additional heating of the susceptor. As the susceptor is located in thermal contact or proximity with the aerosol-forming substrate, the aerosol-forming substrate is heated by the susceptor.

The term 'thermal proximity' is used herein with reference to the susceptor and aerosol-forming substrate to mean that the susceptor is positioned relative to the aerosol-forming substrate such that an adequate amount of heat is transferred from the susceptor to the aerosol-forming substrate to produce an aerosol. For example, the term 'thermal proximity' is meant to include embodiments in which the susceptor is in intimate physical contact with the aerosol-forming substrate. The term 'thermal proximity' is also meant to include embodiments in which the susceptor is spaced from the aerosol-forming substrate and configured to transfer an adequate amount of heat to the aerosol-forming substrate via convection or radiation.

The power supply electronics are configured to supply power to the inductor in two or more heating pulses separated by time intervals, and one or more probing pulses in the time intervals between successive heating pulses. The power supply electronics may be configured to supply any suitable number of heating pulses. The power supply electronics may be configured to supply a set or group of heating pulses. A set or group of heating pulses may comprise any suitable number of heating pulses. For example, a set or group of heating pulses may comprise between two and twenty heating pulses. In some embodiments, the number of heating pulses may be predetermined for an aerosol-generating experience. In some embodiments, the number of heating pulses in an aerosol-generating experience may be variable. The number of heating pulses in an aerosol-generating experience may be controllable by a user. The power supply electronics may be configured to supply any suitable number of probing pulses between successive heating pulses. The power supply electronics may be configured to supply a set or group of probing pulses between successive heating pulses. For example, a set or group of probing pulses may comprise between one and fifty probing pulses. The number of probing pulses between successive heating pulses may be variable.

The power supply electronics are configured to control the duration of the time interval between successive heating pulses. Since a susceptor coupled to the inductor is allowed to cool over the time interval between successive heating pulses, the power supply electronics may be configured to control the duration of the time interval between successive heating pulses to adjust the temperature of the susceptor at the start of the next heating pulse in the series. In some embodiments, the duration of the heating pulses may be substantially fixed or constant. However, typically the duration of the heating pulses is not fixed. The power supply electronics may be configured to control the duration of each heating pulse based on one or more measurements of the current supplied by the DC power supply in the heating pulse, as described in more detail later on. As such, the duration of each heating pulse may be dependent on the temperature of the susceptor in the heating pulse.

Independent adjustment of the duration of the heating pulses and the duration of the time intervals between successive heating pulses may provide particularly effective and efficient heating of a susceptor coupled to the inductor and generation of an acceptable aerosol from the aerosol-forming substrate in thermal proximity to the susceptor.

During the time interval between two successive heating pulses, a susceptor coupled to the inductor is allowed to cool. The duration of the time interval between two successive heating pulses is ideally long enough for the susceptor to cool below the maximum temperature for generation of an acceptable aerosol, but not so long that the susceptor cools below a minimum temperature for generation of an acceptable aerosol. As such, each susceptor and aerosol-forming substrate arrangement may have a different and particular ideal duration for the time interval between successive heating pulses.

Fluctuations in the current from the DC power supply may indicate changes in the susceptor or aerosol-generating article. For example, a sudden increase in the current measured in either the heating pulses or the probing pulses may indicate that the susceptor has been rapidly cooled. Rapid cooling of the susceptor may occur from air being drawn over the susceptor during a puff on the aerosol-generating article by a user. As such, the power supply electronics of the inductive heating device may be configured to detect puffs based on fluctuations in the measurements of current supplied from the DC power supply.

Typically, the DC power supply supplies a constant voltage when power is supplied to the inductor from the DC power supply. Typically, the voltage supplied by the DC power supply is substantially similar in each pulse. The voltage supplied by the DC power supply may be substantially similar in each heating pulse. The voltage supplied by the DC power supply may be substantially similar in each probing pulse. The voltage supplied by the DC power supply in each probing pulse may be substantially equal to the voltage supplied by the DC power supply in each heating pulse. However, in some embodiments, the voltage supplied by the DC power supply in each probing pulse may be lower than the voltage supplied by the DC power supply in each heating pulse.

A probing pulse may have any suitable duration. Where two or more probing pulses are supplied to the inductor from the DC power supply in the time interval between two successive heating pulses, each probing pulse may have a substantially similar duration. The duration of each probing pulse may be substantially equal to a probing pulse duration. The probing pulse duration may be a predetermined value. The probing pulse duration may be stored in a memory of the power supply electronics. The probing pulse duration may be between about 2 milliseconds and about 20 milliseconds or between about 5 milliseconds and about 15 milliseconds. The probing pulse duration may be between about 10 milliseconds. The probing pulse duration is typically substantially shorter than the duration of the heating pulses, such that the probing pulses do not substantially increase the temperature of a susceptor coupled to the inductor.

Where two or more probing pulses are supplied to the inductor from the DC power supply in the time interval between two successive heating pulses, successive probing pulses may be separated by a probing pulse time interval. The probing pulse time interval may be a predetermined value. The probing pulse time interval may be stored in a memory of the power supply electronics. Typically, the probing pulse time interval duration is longer than the probing pulse duration, such that a susceptor coupled to the inductor is allowed to cool between probing pulses. The probing pulse time interval may be substantially constant or fixed. The probing pulse time interval may be between about 50 milliseconds and about 50 milliseconds or between about 70 milliseconds and about 120 milliseconds. The probing pulse time interval duration may be about 90 milliseconds.

Where a series of two or more probing pulses are supplied to the inductor from the DC power supply in the time interval between two successive heating pulses, and where each probing pulse has a probing pulse duration and successive probing pulses are separated by a probing pulse time interval, the series or sequence of probing pulses may be substantially regular. The power supply electronics may be configured to supply the first probing pulse in the series after the probing pulse time interval has elapsed after the end of a heating pulse. The power supply electronics may be configured to supply the next heating pulse after the probing pulse time interval has elapsed after the end of the final probing pulse in the series, when the time interval between the successive heating pulses has elapsed.

In some embodiments, the number of probing pulses between successive heating pulses may be fixed. However, typically, the number of probing pulses between successive heating pulses is not fixed. Typically, the number of probing pulses between successive heating pulses depends on the rate of cooling of the susceptor between successive heating pulses.

In some embodiments, the power supply electronics are configured to supply a regular series or sequence of probing pulses to the inductor from the DC power supply between successive heating pulses. Each probing pulse may have a duration substantially equal to a probing pulse duration and the time interval between successive probing pulses may be substantially equal to a probing pulse time interval. In these embodiments, the number of probing pulses supplied to the inductor between the successive heating pulses is dependent on the determined time interval between the successive heating pulses.

In some embodiments, the heating pulses comprise at least a first heating pulse and a second heating pulse, separated from the first heating pulse by a time interval. The power supply electronics may be configured to supply power to the inductor from the DC power supply in one or more probing pulses in the time interval between the first heating pulse and the second heating pulse. The power supply electronics may also be configured to control the duration of the time interval between the first and second heating pulses based on measurements of current supplied from the DC power supply in one or more of the probing pulses.

In some embodiments, the power supply electronics may be configured to compare the one or more measurements of current in the one or more probing pulses to one or more target conditions. The measurements of current supplied by the DC power supply in one or more of the probing pulses may be required to meet one or more of the target conditions before the next heating pulse is initiated. As such, the power supply electronics may be configured to control the duration of the time interval between successive heating pulses based on a comparison of the one or more measurements of current in the one or more probing pulses to the one or more target conditions. The one or more target conditions may be stored on a memory of the power supply electronics.

A target condition may be any suitable target condition.

A target condition may comprise a comparison of the measurements of current in the one or more probing pulses to an absolute value. For example, a target condition may comprise a measurement of current in a probing pulse substantially equalling or exceeding a reference current value. The reference current value may be stored in a memory of the power supply electronics. The power supply electronics may be configured to supply power to the inductor from the DC power supply in a second heating pulse if the current measured in a probing pulse substantially equals or exceeds the reference current value.

A target condition may comprise a relative value or condition, such as a comparison between measurements of current for successive probing pulses in a series of probing pulses. For example, a target condition may comprise a decrease in the measurements of current for successive probing pulses in a series of probing pulses. The power supply electronics may be configured to supply power to the inductor from the DC power supply in a second heating pulse if the current measured over successive probing pulses decreases.

In some embodiments, a target condition may comprise a sequence or a series of conditions or targets. The power supply electronics may be configured to compare measurements of current in successive probing pulses to each one of the sequence or series of target conditions, in turn, in the order of the sequence or series.

In some embodiments, the power supply electronics may be configured to determine that a current measured in a series of probing pulses is a minimum current in the series of probing pules and supply power to the inductor in a second heating pulse if a minimum current in the series of probing pulses is determined to have occurred. The power supply electronics may be configured to determine that a current measured in a series of probing pulses is a minimum current in the series of probing pules in any suitable way. The power supply electronics may be configured to determine that a current measured in a series of probing pulses is a minimum current in the series of probing pules by comparing successive probing pulses in the series of probing pulses, determining that the current supplied from the DC power supply in a first pair of successive probing pulses decreases between the successive probing pulses and determining that the current supplied from the DC power supply in a second pair of successive probing pulses increases between the successive probing pulses.

In some embodiments, a sequence of target conditions stored on the memory of the power supply electronics may comprise: the current supplied from the DC power supply in a first pair of successive probing pulses decreases between the successive probing pulses; and the current supplied from the DC power supply in a second pair of successive probing pulses increases between the successive probing pulses. The second pair of successive probing pulses may be any suitable pair of successive probing pulses after the first pair of successive probing pulses. For example, the second pair of successive probing pulses may include the second one of the first pair of successive probing pulses, the second pair of successive probing pulses may directly follow the first pair of successive probing pulses (i.e. the first one of the second pair of successive pulses may be the successive probing pulse to the second one of the first pair of successive probing pulses) or one or more probing pulses may be supplied to the inductor between the first pair of successive probing pulses and the second pair of successive probing pulses.

In some embodiments, a sequence of target conditions stored on the memory of the power supply electronics may comprise: the current supplied from the DC power supply in a first pair of successive probing pulses decreases between the successive probing pulses; the current supplied from the DC power supply in a second pair of successive probing pulses increases between the successive probing pulses; and the current supplied from the DC power supply at or after the second pair of successive probing pulses is equal to or greater than a reference current value.

In some embodiments, the power supply electronics are configured, for each heating pulse, to determine at least one of: when the current supplied from the DC power supply is at a minimum current value; when the current supplied from the DC power supply is at a maximum current value; and a mid-point between the determined minimum and maximum current values. The power supply electronics may be further configured to determine a reference or target current value based at least one of the determined minimum, maximum and mid-point current values. The determined reference or target value may be a target condition. The power supply electronics may be configured to control the duration of the time interval between two successive heating pulses based on a comparison between measurements of DC current in one or more of the probing pulses between the successive heating pulses and the reference or target current value.

The power supply electronics may be further configured to supply power to the inductor in a second heating pulse when one or more of the measurements of current in the probing pulses matches a target condition or the time period after the end of the first heating pulse reaches a maximum time interval duration. The maximum time interval duration may be predetermined. The maximum time interval duration may be stored in a memory of the power supply electronics.

In some embodiments, the power supply electronics may be configured to supply power to the inductor from the DC power supply in a second heating pulse after a maximum time interval duration has elapsed from the end of a first heating pulse. This may enable the inductive heating device to continue to supply heating pulses to the inductor for heating the susceptor even if the target conditions are not met within a certain time period. The maximum time interval duration may be any suitable duration. For example, the maximum time interval duration may be between about 3 s and about 6 s or between about 4 s and about 5 s. The maximum time interval duration may be about 4.5 s. The maximum time interval duration may be stored in a memory of the power supply electronics.

In an exemplary embodiment, the power supply electronics are configured to supply power to the inductor from the DC power supply in a first heating pulse and interrupt the supply of power to the inductor to end the first heating pulse. The power supply electronics are further configured to supply power to the inductor in a first probing pulse after a probing pulse time interval from the end of the first heating pulse has elapsed. The power supply electronics are also configured to measure the current supplied from the DC power supply in the first probing pulse and, after a probing pulse duration from the start of the first probing pulse has elapsed, interrupt the supply of power to the inductor to end the first probing pulse. The power supply electronics are configured to compare one of more measurements of the current in the first probing pulse to one or more target conditions, and supply power to the inductor in a second heating pulse if one or more of the measurements of current match a target condition.

In a further exemplary embodiment, the power supply electronics are configured to supply power to the inductor in a second probing pulse after the probing pulse time interval from the end of the first probing pulse has elapsed, if the one or more measurements of current in the first probing pulse do not match a target condition. The power supply electronics are further configured to measure the current supplied from the DC power supply in the second probing pulse and interrupt the supply of power to the inductor to end the second probing pulse after the probing pulse duration from the start of the second probing pulse has elapsed. The power supply electronics are also configured to compare one or more measurements of the current in the second probing pulse to one or more of the target conditions and supply power to the inductor in a second heating pulse if one or more of the measurements of current in the one or more probing pulses matches a target condition.

In yet a further exemplary embodiment, the power supply electronics are configured to continue to supply power to the inductor from the DC power supply in a series of probing pulses, wherein each probing pulse has a duration substantially equal to the probing pulse duration and successive probing pulses are separated by time intervals substantially equal to the probing pulse time interval. The power supply electronics are further configured to supply power to the inductor in a second heating pulse when one or more of the measurements of current in the probing pulses matches a target condition or the time period after the end of the first heating pulse reaches a maximum time interval duration.

For each heating pulse, the power supply electronics may be configured to interrupt the supply of power to the inductor from the DC power supply if the measured current value indicates the temperature of a susceptor coupled to the inductor is at or above a maximum temperature. To achieve this, a reference maximum current value, corresponding to a maximum temperature of a susceptor coupled to the inductor, may be stored in a memory of the power supply electronics. The power supply electronics may be configured to measure the current supplied from the DC power supply to the inductor, compare the measured current to the stored reference current value and interrupt the supply of power from the DC power supply to the inductor based on the comparison. For example, a reference minimum current value may be stored in a memory of the power supply electronics and the power supply electronics may be configured to interrupt the supply of power from the DC power supply to the inductor if the measured current value reaches or falls below the reference minimum current value. In some embodiments, such an interruption in the supply of power from the DC power supply to the inductor may define the end of the heating pulses. In these embodiments, the end of the heating pulses is determined from measurements of the current supplied from the DC power supply in the heating pulse. In these embodiments, the duration of the heating pulses is not fixed, but is dependent on the current supplied to the inductor, and so is indirectly dependent on the temperature of the susceptor.

In some embodiments, the power supply electronics may be configured to detect variations in the rate of change of measured current values from the DC power supply in each heating pulse. In these embodiments, the power supply electronics may be configured to interrupt the supply of power from the DC power supply to the inductor based on a detection of a variation in the rate of change of the measured current values. For example, a susceptor coupled to the inductor of the inductive heating device may comprise a material having a Curie temperature that is below any predetermined maximum heating temperature for the aerosol-forming substrate, as described in more detail below. When the susceptor is heated to the Curie temperature, the rate of change of the measured current value in a heating pulse may change. In other words, an extrema, such as a maximum or minimum, may be detected in the rate of change of the measured current as a phase change occurs in the susceptor material. This may provide an indication that the susceptor is at the Curie temperature and the aerosol-forming substrate is at the predetermined maximum temperature. Thus, the power supply electronics may be configured to interrupt the supply of power from the DC power supply in a heating pulse to stop or prevent further heating of the aerosol-forming substrate. In some embodiments, such an interruption in the supply of power from the DC power supply to the inductor may define the end of each heating pulse.

Various proposals have been made in the art for adapting a susceptor in order to control the temperature of a susceptor in an aerosol-generating article. For example, in WO-A1-2015/177294 an aerosol-generating system is proposed that comprises a susceptor having a first susceptor material and a second susceptor material. The first susceptor material is in thermal proximity to the second susceptor material.

The term 'thermal proximity' is used herein with reference to a susceptor having a first susceptor material and a second susceptor material to mean that the first susceptor material is positioned relative to the second susceptor material such that when the susceptor is heated by an alternating electromagnetic field generated by an inductor, heat is transferred between the first susceptor material and the second susceptor material. For example, the term 'thermal proximity' is meant to include embodiments in which the first susceptor material is in intimate physical contact with the second susceptor material. The term 'thermal proximity' is also meant to include embodiments in which the first susceptor material is spaced from the second susceptor material and the first and second susceptor materials.

In some embodiments, the first and second susceptor materials may be in intimate contact or intimate physical contact, forming a unitary susceptor. In these embodiments, when heated, the first and second susceptor materials have substantially the same temperature.

The first susceptor material, which may be optimized for the heating of the aerosol-forming substrate, may have a first Curie temperature which is higher than any predefined maximum heating temperature for the aerosol-forming substrate. The second susceptor material, which may be optimized for regulating the temperature of the aerosol-forming substrate, may have a second Curie temperature which is below any predefined maximum heating temperature for the aerosol-forming substrate. Once the susceptor has reached the second Curie temperature, the magnetic properties of the second susceptor material change. At the second Curie temperature the second susceptor material reversibly changes from a ferromagnetic phase to a paramagnetic phase. During the inductive heating of the aerosol-forming substrate this phase-change of the second susceptor material may be detected by the inductive heating device without physical contact with the second susceptor material. Detection of the phase change may allow the inductive heating device to control the heating of the aerosol-forming substrate.

For example, on detection of a phase change associated with a second Curie temperature, inductive heating may be stopped automatically. Thus, an overheating of the aerosol-forming substrate may be avoided, even though the first susceptor material, which is primarily responsible for the heating of the aerosol-forming substrate, has no Curie temperature or a first Curie-temperature which is higher than the maximum desirable heating temperature. After the inductive heating has been stopped the susceptor cools down until it reaches a temperature lower than the second Curie temperature. At this point the second susceptor material regains its ferromagnetic properties again.

The inductive heating device of the present invention may be configured to receive an aerosol-generating article comprising a susceptor having a first susceptor material and a second susceptor material. The inductive heating device of the present invention may further be configured to control the supply of power from the DC power supply to the inductor based on detection of a phase change of a second susceptor material in the susceptor. In other words, the power supply electronics of the inductive heating device of the present invention may be configured to detect a phase change in a second susceptor material of a susceptor coupled to the inductor and stop or reduce the power supplied from the DC power supply on detection of a phase change.

In some particular embodiments, the inductive heating device may be configured to receive an aerosol-generating article comprising a susceptor comprising a first susceptor material and a second susceptor material, the first susceptor material being disposed in thermal proximity to the second susceptor material, and the second susceptor material having a Curie temperature that is lower than 500° C. For each heating pulse, the power supply electronics of the inductive heating device of the present invention may be configured to: determine when the current supplied from the DC power supply is at a maximum current value; stop, reduce or interrupt the supply of power from the DC power supply to the inductor to end the heating pulse when the maximum current value is determined; and after the determined time interval based on the measured current of the probing pulses, start or increase the supply of power from the DC power supply in a second heating pulse, such that power is supplied to the inductor from the DC power supply in a series of heating pulses.

In these particular embodiments, the power supply electronics are not only configured to control the duration of the time interval between successive heating pulses of power supplied by the DC power supply, but also the power supply electronics are configured to control the duration of each heating pulse based on measurements of the current supplied from the DC power supply.

Figure 9:
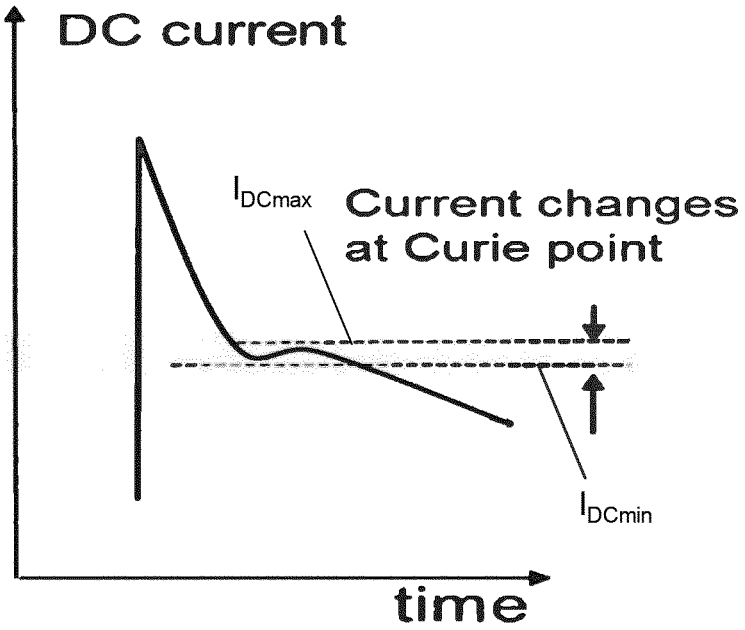
FIG. 9 is a graph of current vs. time illustrating the remotely detectable current changes that occur when a susceptor material undergoes a phase transition associated with its Curie point.

The relationship between the current supplied from the DC power supply and the temperature of a susceptor having two susceptor materials is described in more detail below, in particular with reference to FIG. 9. However, in general, the profile of the current supplied from the DC power supply exhibits a temporary inflection as the susceptor reaches the second Curie temperature and the second susceptor material experiences a phase change.

For example, in some of these particular embodiments the apparent resistance of the susceptor increases as the susceptor is heated to the second Curie temperature. When the susceptor reaches the second Curie temperature, the apparent resistance of the susceptor exhibits a first extrema, in this example, a maximum, and subsequently the apparent resistance of the susceptor decreases temporarily. This temporary decrease results from the second susceptor losing its magnetic properties during the phase change. Once the phase change is completed, the apparent resistance of the susceptor exhibits a second extrema, in this example, a minimum, and subsequently the apparent resistance of the susceptor increases again as the DC power supply continues to supply power to the inductor to heat the susceptor.

The measured current supplied from the DC power supply exhibits an inverse relationship to the apparent resistance of the susceptor, as expected from Ohm's law. As such, in this exemplary embodiment, the measured current decreases as the susceptor is heated to the second Curie temperature. At the second Curie temperature, the measured current reaches a minimum $I_{DCMIN}$ and temporarily increases until it reaches a maximum $I_{DCMAX}$ after which the measured current decreases again as the susceptor is heated further.

The power supply electronics of the inductive heating device of the present invention may be configured to detect the Curie transition of the second susceptor material. In other words, the power supply electronics of the inductive heating device of the present invention may be configured to detect a temporary inflection in the profile of the current supplied from the DC power supply caused by the phase change of the second susceptor material. Detection of the Curie transition may enable the power supply electronics to determine when to stop or reduce the amount of power being supplied to susceptor to avoid the susceptor from overheating the aerosol-forming substrate.

Detection of an extrema, such as a maximum or minimum value, in measurements of the current supplied from the DC power supply may indicate that a phase change of a susceptor material is taking place. In particular, detection of a first extrema, such as a minimum, in the current supplied from the DC power supply may indicate that the susceptor has reached the second Curie temperature. Detection of a second extrema, such as a maximum, in the current supplied from the DC power supply may indicate that the phase change of the second susceptor material has taken place.

The inflection in the current supplied from the DC power supply provides an indicator of the temperature of the susceptor. The Curie temperature of the second susceptor material may be chosen to be within a temperature range for generating a suitable or an acceptable aerosol from the aerosol-forming substrate without igniting the aerosol-forming substrate.

In some embodiments, the power supply electronics may be configured detect a maximum value of the current in a heating pulse. The power supply electronics may be further configured to interrupt the supply of power from the DC power supply to the inductor when the maximum value is detected. This interruption may define the end of a heating pulse.

The power supply electronics may be configured to determine when the current supplied from the DC power supply is at a minimum current value in a heating pulse.

In some particular embodiments, the power supply electronics may be configured to: determine a mid-point between the determined minimum current value of a heating pulse and the determined maximum current value of a heating pulse.

The power supply electronics may be configured to store at least one of the determined maximum, minimum and mid-point current values in a heating pulse in a memory of the power supply electronics. The power supply electronics may also be configured to compare measurements of current in one more probing pulses to at least one of the stored maximum, minimum and mid-point current values of the heating pulse. The power supply electronics may be configured to control the duration of the time interval between successive heating pulses based on the comparison.

By using at least one of the determined maximum, minimum current and mid-point between the determined maximum and minimum current values in a heating pulse as a target or reference current vale against which measurements of current in one or more of the probing pulses are compared, rather than a pre-determined target or reference value, the inductive heating device of the present invention may be suitable for use with different arrangements of susceptors and aerosol-forming substrates without requiring multiple target or reference values to be stored on a memory of the power supply electronics.

For each particular susceptor and aerosol-forming substrate arrangement, the determined maximum and minimum current values should be the same or very similar. This is because, for each particular susceptor and aerosol-forming substrate arrangement, the determined maximum and minimum current values should occur when the susceptor is at a particular temperature, which should be the same for each heating pulse (i.e. when the susceptor is at or near the second Curie temperature). Accordingly, the mid-point between the determined maximum and minimum current values should also be the same or very similar for each successive heating pulse.

It has been found that the mid-point between the determined maximum and minimum current values is a particularly suitable initial current value for each heating pulse. Thus, the power supply electronics may be configured to adjust the time interval durations between successive heating pulses such that the initial current values of the heating pulses are at or around the mid-point between the determined minimum and maximum current values over a number of pulses.

In some embodiments, the power supply electronics are configured to control the duration of the time interval between successive heating pulses based on more or more measurements of the current supplied from the DC power supply and the voltage across the DC power supply in one or more of the probing pulses. Preferably, the power supply electronics are configured to determine a conductance value based on the one or more measurements of current supplied from the DC power supply and the voltage across the DC power supply in one or more of the probing pulses. A conductance value may be determined from the quotient or ratio of a current measurement and a voltage measurement. The power supply electronics may be configured to determine the quotient of one or more current measurements and one or more voltage measurements. In other words the power supply electronics may be configured to determine a conductance value by dividing one or more measurements of current by one or more measurements of voltage.

Preferably, the power supply electronics are configured to control the duration of the time interval between successive heating pulses based on one or more of the determined conductance values. Surprisingly, it has been found that controlling the duration of the time interval between successive heating pulses has provided improved stability and reliability of the temperature control of the susceptor compared control based on measurements of current alone.

It will be appreciated that all references to measurement of current referred to herein may additionally include measurements of voltage. It will be appreciated that all references to measurement of current referred to herein may additionally include measurements of voltage and determinations of conductance. It will also be appreciated that references to target current values and target current conditions referred to herein may include target conductance values and target conductance conditions. In other words, references to the control circuitry being configured to control the duration of the time interval between successive heating pulses based on one or more measurements of current may also include embodiments wherein the power supply electronics are configured to control the duration of the time interval between successive heating pulses based on one or more determinations of conductance.

The inductive heating device of the first aspect of the present invention and an aerosol-generating article may form an electrically operated aerosol-generating system according to a second aspect of the present invention. The aerosol-generating article may comprise an aerosol-forming substrate and a susceptor in thermal proximity to the susceptor. The inductive heating device may be configured to receive the susceptor and to heat the susceptor when the aerosol-generating article is received by the inductive heating device. The inductor of the inductive heating device may generate a fluctuating electromagnetic field to induce eddy currents in the susceptor, causing the susceptor to heat up.

The inductive heating device or electrically operated aerosol-generating device of the present invention may comprise: a housing; a cavity for receiving an aerosol-generating article; an inductor arranged to generate a fluctuating electromagnetic field within the cavity; a DC power supply for supplying electrical power to the inductor; and power supply electronics configured to control the supply of power from the power supply to the inductor.

The inductive heating device comprises a DC power supply for supplying electrical power to the inductor. The DC power supply is configured to supply a DC supply voltage and a current. The DC power supply may be any suitable DC power supply. For example, the DC power supply may be a single use battery or a rechargeable battery. In some embodiments, the power supply may be a Lithium-ion battery. In other embodiments, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. In some embodiments, the DC power supply may comprise one or more capacitors, super capacitors or hybrid capacitors. The DC power supply may comprise one or more lithium ion hybrid capacitors.

The DC power supply may be configured to supply any suitable DC voltage and current. The DC power supply may be configured to supply a DC voltage in the range of between about 2.5 Volts and about 4.5 Volts and a current in the range of between about 2.5 Amperes and about 5 Amperes, corresponding to a DC power in the range of between about 6.25 Watts and about 22.5 Watts.

The inductive heating device also comprises an inductor for coupling to a susceptor of an aerosol-generating article. The inductor may comprise a coil. The coil may be a helically wound cylindrical inductor coil. The inductor may be positioned on or adjacent to the internal surface of the cavity of the device. The coil may surround the cavity. In some embodiments, the inductor coil may have an oblong shape and define an inner volume in the range of about 0.15 $cm^3$ to about 1.10 $cm^3$. For example, the inner diameter of the helically wound cylindrical inductor coil may be between about 5 mm and about 10 mm or about 7 mm, and the length of the helically wound cylindrical inductor coil may be between about 8 mm and about 14 mm. The diameter or the thickness of the inductor coil wire may be between about 0.5 mm and about 1 mm, depending on whether a coil wire with a circular cross-section or a coil wire with a flat rectangular cross-section is used. The helically wound inductor coil may be positioned on or adjacent the internal surface of the cavity. A helically wound cylindrical inductor coil positioned on or adjacent the internal surface of the cavity enables the device to be compact. The inductor may comprise one coil or more than one coil.

The inductive heating device also comprises power supply electronics configured to control the supply of power from the DC power supply to the inductor.

The power supply electronics may comprise DC/AC converter or inverter for converting current from the DC power supply into an AC current for supply to the inductor.

The DC/AC converter may be configured to operate at high frequency. As used herein, the term "high frequency" is used to describe a frequency ranging from about 1 Megahertz (MHz) to about 30 Megahertz (MHz), from about 1 Megahertz (MHz) to about 10 MHz (including the range of about 1 MHz to about 10 MHz), and from about 5 Megahertz (MHz) to about 7 Megahertz (MHz) (including the range of about 5 MHz to about 7 MHz).

The DC/AC converter may comprise an LC load network. The LC network may comprise the inductor for coupling to a susceptor of an aerosol-generating article. The inductor may be arranged in series with a capacitor in the LC load network. The LC load network may further comprise a shunt capacitor.

The LC load network may be configured to operate at low ohmic load. As used herein, the term "low ohmic load" is used to describe an ohmic load smaller than about 2 Ohms. The electrical resistance of the inductor may typically be a few tenths of an Ohm. Typically, the electrical resistance of the susceptor will be higher than the electrical resistance of the inductor, so that the susceptor may be configured to efficiently convert the majority of the electrical power supplied to it into heat for heating the aerosol-forming substrate. During heating of the susceptor, the electrical resistance of the susceptor will also typically increase as the temperature of the susceptor increases. In operation, the electrical resistance of the susceptor may be effectively added to the electrical resistance of the inductor to increase the ohmic load of the LC load network.

The DC/AC converter may comprise a power amplifier. In particular, the DC/AC converter may comprise a Class-E power amplifier comprising a transistor switch and a transistor switch driver circuit. Class-E power amplifiers are generally known and are described in detail, for example, in the article "Class-E RF Power Amplifiers", Nathan O. Sokal, published in the bimonthly magazine QEX, edition January/February 2001, pages 9-20, of the American Radio Relay League (ARRL), Newington, Conn., U.S.A. Class-E power amplifiers may advantageously operate at high frequencies, while also having a relatively simple circuit structure comprising a small number of components (e.g. Class-E power amplifiers require one transistor switch only, which is advantageous over Class-D power amplifiers, which require two transistor switches controlled at high frequency to ensure that when one of the two transistors is switched off, the other of the two transistors is switched on). In addition, Class-E power amplifiers are known to have low power dissipation across the switching transistor during switching transitions. The Class-E power amplifier may be a single-ended first order Class-E power amplifier having a single transistor switch only.

In embodiments comprising a Class-E power amplifier, the transistor switch may be any suitable type of transistor. For example, the transistor may be a bipolar-junction transistor (BJT) or a field effect transistor (FET), such as a metal-oxide-semiconductor field effect transistor (MOSFET) or a metal-semiconductor field effect transistor (MESFET).

The class E power amplifier may have an output impedance and the power supply electronics may further comprise a matching network for matching the output impedance of the class E power amplifier to the low ohmic load of the LC load network. For example, the matching network may comprise a small matching transformer. The matching network may improve power transfer efficiency between the inverter or converter and the inductor.

The power supply electronics may also comprise a microcontroller. The microcontroller may be programmed to control the duration of each pulse of power supplied by the DC power supply to the inductor. The microcontroller may be programmed to control the duration of the time interval between successive pulses of power supplied by the DC power supply to the inductor. The microcontroller may be programmed to determine an apparent resistance ($R_a$) of a susceptor of an aerosol-generating article engaged with the inductive heating device. The microcontroller may be programmed to determine an apparent resistance ($R_a$) of the susceptor from measurements of at least one of the DC voltage ($V_{DC}$) supplied from the DC power supply and the current ($I_{DC}$) drawn from the DC power supply. The microcontroller may be further programmed to determine the temperature of the susceptor of the aerosol-generating article from the apparent resistance ($R_a$). The microcontroller may also be further programmed to determine the temperature of the aerosol-forming substrate of the aerosol-generating article from the temperature of the susceptor.

The power supply electronics may be configured to measure the current drawn from the DC power supply. The power supply electronics may comprise a current sensor for measuring the current drawn from the DC power supply. The power supply electronics may be provided with any suitable current sensor.

The power supply electronics may also be configured to measure the DC voltage supplied by the DC power supply. The power supply electronics may comprise a voltage sensor for measuring the DC voltage supplied by the DC power supply. The power supply electronics may comprise any suitable voltage sensor.

It has been found that an apparent resistance of the susceptor may be determined from measurements of the DC voltage and the current drawn from the DC power supply. Surprisingly, the apparent resistance of a susceptor varies with the temperature of the susceptor in a strictly monotonic relationship over certain ranges of temperature of the susceptor. This strictly monotonic relationship allows for an unambiguous determination of the temperature of the susceptor from a determination of the apparent resistance, as each determined value of the apparent resistance is representative of only one single value of the temperature, there is no ambiguity in the relationship. Although the relationship between the temperature of the susceptor and the apparent resistance is monotonic, it is not necessarily linear. The monotonic relationship of the temperature of the susceptor and the apparent resistance allows for the determination and control of the temperature of the susceptor and thus for the determination and control of the temperature of the aerosol-forming substrate.

The apparent resistance of the susceptor may be calculated from the known relationship between the current drawn from the DC power supply and the DC voltage supplied by the DC power supply, according to Ohm's law. Typically, the apparent resistance of the susceptor is determined based on measurements of the current drawn from the DC power supply. The apparent resistance of the susceptor may also be determined based on measurements of the DC voltage supplied from the DC power supply. However, in some embodiments the DC power supply may be configured to supply a constant DC voltage value. In these embodiments, the constant voltage value supplied by the DC power supply may be known and may be stored, such as in a memory of the microprocessor of the power supply electronics, and may be used in the determination of the apparent resistance of the susceptor. Therefore, in embodiments comprising a constant voltage DC power supply it is not essential for the power supply electronics to be configured to measure the DC voltage supplied by the DC power supply. This may reduce one or more of the number of components, the complexity, the size and the cost of the power supply electronics. It will be appreciated that in some embodiments comprising a constant voltage DC power supply, the power supply electronics may be configured to measure the DC voltage supplied by the DC power supply and measurements of the DC voltage may be used in the determination of the apparent resistance of the susceptor.

In some embodiments, where the DC power supply comprises a DC power supply that supplied a constant voltage value, the power supply electronics may be configured to store a reference constant voltage value that is indicative of the constant voltage value supplied by the constant voltage DC power supply. In these embodiments, the power supply electronics may not be required to monitor the DC voltage supplied by the DC power supply. However, it will be appreciated that in these embodiments a voltage sensor may also be provided for monitoring the DC voltage value supplied by the DC power supply.

The power supply electronics may also comprise an additional inductor arranged as a DC choke.

The size or total volume of the power supply electronics may be particularly small. For example, the size or total volume of the power supply electronics may be equal to or less than 2 $cm^3$. This small size is due to the low number of components of the power supply electronics. A particularly small size or volume is possible in embodiments where the inductor of the LC load network is used as the inductor for the inductive coupling to the susceptor of the aerosol-forming article. A particularly small size or volume is also possible in embodiments that do not comprise a matching network. The small size or small volume of the power supply electronics helps to keep the overall size or volume of the inductive heating device particularly small.

The inductive heating device also comprises a cavity for receiving an aerosol-generating article. The cavity may have an internal surface shaped to accommodate at least a portion of the aerosol-forming substrate of an aerosol-generating article. The cavity may be arranged such that upon accommodation of a portion of the aerosol-forming substrate of an aerosol-generating article in the cavity, the inductor of the LC load network is inductively coupled to the susceptor of the aerosol-forming substrate during operation. This arrangement may enable the inductor of the LC load network to couple to the susceptor of the aerosol-generating article and heat the susceptor through induction of eddy currents. This arrangement may eliminate the need for additional components such as matching networks for matching the output impedance of the Class-E power amplifier to the load, thus allowing to further minimize the size of the power supply electronics.

The inductive heating device may comprise means for operating the device. In some embodiments, the means for operating the device may comprise a simple user-operated switch.

Overall, the inductive heating device of the present invention provides a small and easy to handle, efficient, clean and robust heating device. This is primarily due to the contactless heating of the substrate and the arrangement and configuration of the power supply electronics.

For susceptors forming low ohmic loads and having an electrical resistance significantly higher than the electrical resistance of the inductor of the LC load network, as specified above, the inductive heating device of the present invention may heat the susceptor to a temperature in the range of 300-400 degrees Celsius in a time period of around five seconds, or even less than five seconds in some embodiments. At the same time, the temperature of the inductor of the inductive heating device may be maintained well below the temperature of the susceptor due to a vast majority of the power being converted to heat in the susceptor, rather than in the inductor.

In some embodiments, the inductive heating device may be configured to supply power to a susceptor arranged within an aerosol-forming substrate such that the aerosol-forming substrate may be heated to an average temperature of between about 200° C. and about 240° C.

The inductive heating device may be capable of generating a fluctuating electromagnetic field having a magnetic field strength (H-field strength) of between about 1 kilo amperes per metre (kA/m) and about 5 kA/m, between about 2 kA/m and about 3 kA/m or about 2.5 kA/m. The inductive heating device may be capable of generating a fluctuating electromagnetic field having a frequency of between about 1 megahertz and about 30 megahertz, between about 1 megahertz and about 10 megahertz or between about 5 megahertz and about 7 megahertz.

The inductive heating device may be a portable or hand-held electrically operated aerosol-generating device that is comfortable for a user to hold between the fingers of a single hand.

The inductive heating device may have a length of between about 70 millimetres and about 120 millimetres.

The inductive heating device may be substantially cylindrical in shape.

Specifically, the inductive heating device may comprise: a device housing; and a cavity arranged in the device housing, the cavity having an internal surface shaped to accommodate at least a portion of the aerosol-forming substrate, the cavity being arranged such that upon accommodation of the portion of the aerosol-forming substrate in the cavity, the inductor is inductively coupled to the susceptor of the inductive heating device during operation of the device. The power supply electronics may also be configured to operate at high frequency, the DC/AC converter comprising an LC load network configured to operate at low ohmic load, wherein the LC load network comprises a series connection of a capacitor and the inductor having an ohmic resistance, and wherein the power supply electronics comprises a microcontroller programmed to control the power supplied from the DC power supply to the inductor.

An aerosol-generating article may also be provided as part of an aerosol-generating system according to a second aspect of the present invention. The aerosol-generating article may be in the form of a rod that comprises two ends: a mouth end, or proximal end, through which aerosol exits the aerosol-generating article and is delivered to a user, and a distal end. In use, a user may draw on the mouth end in order to inhale aerosol generated by the aerosol-generating article. The mouth end is downstream of the distal end. The distal end may also be referred to as the upstream end and is upstream of the mouth end.

As used herein, the terms 'upstream' and 'downstream' are used to describe the relative positions of elements, or portions of elements, of the aerosol-generating article in relation to the direction in which a user draws on the aerosol-generating article during use thereof.

When used herein in relation to an aerosol-generating article, the term 'longitudinal' is used to describe the direction between the mouth end and the distal end of the aerosol-generating article and the term 'transverse' is used to describe the direction perpendicular to the longitudinal direction.

As used herein in relation to an aerosol-generating article, the term 'diameter' is used to describe the maximum dimension in the transverse direction of the aerosol-generating article. When used herein in relation to an aerosol-generating article, the term 'length' is used to describe the maximum dimension in the longitudinal direction of the aerosol-generating article.

The aerosol-generating article comprises a susceptor. The susceptor is arranged in thermal proximity to the aerosol-forming substrate. Thus, when the susceptor heats up the aerosol-forming substrate is heated up and an aerosol is formed. The susceptor may be arranged in direct or intimate physical contact with the aerosol-forming substrate, for example within the aerosol-forming substrate.

The susceptor may be in the form of a pin, rod, or blade. The susceptor may have a length of between about 5 mm and about 15 mm, between about 6 mm and about 12 mm or between about 8 mm and about 10 mm. The susceptor may have a width of between about 1 mm and about 6 mm and may have a thickness of between about 10 micrometres and about 500 micrometres or between about 10 and 100 about micrometres. If the susceptor has a constant cross-section, for example a circular cross-section, it may have a width or diameter of between about 1 mm and about 5 mm.

The susceptor may have a length dimension that is greater than its width dimension or its thickness dimension, for example greater than twice its width dimension or its thickness dimension. Thus the susceptor may be described as an elongate susceptor. The susceptor may be arranged substantially longitudinally within the rod. This means that the length dimension of the elongate susceptor is arranged to be about parallel to the longitudinal direction of the rod, for example within plus or minus 10 degrees of parallel to the longitudinal direction of the rod. The elongate susceptor element may be positioned in a radially central position within the rod, and extend along the longitudinal axis of the rod.

In some embodiments, the aerosol-generating article may contain a single susceptor. In other embodiments, the aerosol-generating article may comprise more than one susceptor. The aerosol-generating article may have more than one elongate susceptor. Thus, heating may be efficiently effected in different portions of the aerosol-forming substrate.

In some preferred embodiments, the susceptor comprises a first susceptor material and a second susceptor material. The first susceptor material may be disposed in thermal proximity to the second susceptor material. The first susceptor material may be disposed in intimate physical contact with the second susceptor material. The second susceptor material may have a Curie temperature that is lower than 500° C. The first susceptor material may be used primarily to heat the susceptor when the susceptor is placed in a fluctuating electromagnetic field. Any suitable material may be used. For example the first susceptor material may be aluminium, or may be a ferrous material such as a stainless steel. The second susceptor material may be used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and the temperature control of the heating may be separated. While the first susceptor material may be optimized with regard to heat loss and thus heating efficiency, the second susceptor material may be optimized in respect of temperature control. The second susceptor material need not have any pronounced heating characteristic. The second susceptor material may be selected to have a Curie temperature, or second Curie temperature, which corresponds to a predefined maximum desired heating temperature of the first susceptor material. As used herein, the term 'second Curie temperature' refers to the Curie temperature of the second susceptor material.

More specifically, the susceptor may comprise a first susceptor material having a first Curie temperature and a second susceptor material having a second Curie temperature, the first susceptor material being disposed in thermal proximity to the second susceptor material. The second Curie temperature may be lower than the first Curie temperature.

The maximum desired heating temperature may be defined such that a local overheating or burning of the aerosol-forming substrate is avoided. The susceptor comprising the first and second susceptor materials may have a unitary structure and may be termed a bi-material susceptor or a multi-material susceptor. The immediate proximity of the first and second susceptor materials may be of advantage in providing an accurate temperature control.

The first susceptor material may be a magnetic material having a Curie temperature that is above about 500° C. It is desirable from the point of view of heating efficiency that the Curie temperature of the first susceptor material is above any maximum temperature that the susceptor should be capable of being heated to. The second Curie temperature may be selected to be lower than about 400° C., lower than about 380° C. or lower than about 360° C. The second susceptor material may be a magnetic material selected to have a second Curie temperature that is substantially the same as a desired maximum heating temperature. That is, the second Curie temperature may be about the same as the temperature that the susceptor should be heated to in order to generate an aerosol from the aerosol-forming substrate. The second Curie temperature may, for example, be within the range of about 200° C. to about 400° C. or between about 250° C. and about 360° C.

In some embodiments, the second Curie temperature of the second susceptor material may be selected such that, upon being heated by a susceptor that is at a temperature equal to the second Curie temperature, an overall average temperature of the aerosol-forming substrate does not exceed 240° C. The overall average temperature of the aerosol-forming substrate here is defined as the arithmetic mean of a number of temperature measurements in central regions and in peripheral regions of the aerosol-forming substrate. By pre-defining a maximum for the overall average temperature the aerosol-forming substrate may be tailored to an optimum production of aerosol.

The first susceptor material may be selected for maximum heating efficiency. Inductive heating of a magnetic susceptor material located in a fluctuating magnetic field occurs by a combination of resistive heating due to eddy currents induced in the susceptor, and heat generated by magnetic hysteresis losses.

In some embodiments, the first susceptor material may be a ferromagnetic metal having a Curie temperature in excess of 400° C. The first susceptor may be iron or an iron alloy such as a steel, or an iron nickel alloy. The first susceptor material may be a 400 series stainless steel such as grade 410 stainless steel, or grade 420 stainless steel, or grade 430 stainless steel.

In other embodiments, the first susceptor material may be a suitable non-magnetic material, such as aluminium. In a non-magnetic material inductive heating occurs solely by resistive heating due to eddy currents.

The second susceptor material may be selected for having a detectable Curie temperature within a desired range, for example at a specified temperature between 200° C. and 400° C. The second susceptor material may also make a contribution to heating of the susceptor, but this property is less important than its Curie temperature. The second susceptor material may be a ferromagnetic metal such as nickel or a nickel alloy. Nickel has a Curie temperature of about 354° C., which may be ideal for temperature control of heating in an aerosol-generating article.

The first and second susceptor materials may be in thermal proximity, such as in intimate contact forming a unitary susceptor. Thus, the first and second susceptor materials have the same temperature when heated. The first susceptor material, which may be optimized for the heating of the aerosol-forming substrate, may have a first Curie temperature which is higher than any predefined maximum heating temperature.

The susceptor may be configured for dissipating energy of between 1 Watt and 8 Watt when used in conjunction with a particular inductor, for example between 1.5 Watt and 6 Watt. By configured, it is meant that the susceptor may comprise a specific first susceptor material and may have specific dimensions that allow energy dissipation of between 1 Watt and 8 Watt when used in conjunction with a particular conductor that generates a fluctuating magnetic field of known frequency and known field strength.

Suitable susceptors having a first susceptor material and a second susceptor material are described in more detail in international patent publication number WO-A1-2015177294A1.

The aerosol-generating article also comprises an aerosol-forming substrate. The aerosol-forming substrate may be a solid aerosol-forming substrate. The aerosol-forming substrate may comprise both solid and liquid components.

The aerosol-forming substrate may comprise nicotine. In some embodiments, the aerosol-forming substrate may comprise tobacco. For example, the aerosol-forming material may be formed from a sheet of homogenised tobacco. The aerosol-forming substrate may be a rod formed by gathering a sheet of homogenised tobacco. The aerosol-forming substrate may comprise a gathered textured sheet of homogenised tobacco material. The aerosol-forming substrate may comprise a gathered crimped sheet of homogenised tobacco material.

As used herein, the term 'homogenised tobacco material' denotes a material formed by agglomerating particulate tobacco. As used herein, the term 'sheet' denotes a laminar element having a width and length substantially greater than the thickness thereof. As used herein, the term 'gathered' is used to describe a sheet that is convoluted, folded, or otherwise compressed or constricted substantially transversely to the longitudinal axis of the aerosol-generating article. As used herein, the term 'textured sheet' denotes a sheet that has been crimped, embossed, debossed, perforated or otherwise deformed. As used herein, the term 'crimped sheet' denotes a sheet having a plurality of substantially parallel ridges or corrugations.

The aerosol-forming substrate may comprise a non-tobacco containing aerosol-forming material. For example, the aerosol-forming material may be formed from a sheet comprising a nicotine salt and an aerosol former.

The aerosol-forming substrate may comprise at least one aerosol-former. As used herein, the term 'aerosol former' is used to describe any suitable known compound or mixture of compounds that, in use, facilitates formation of an aerosol and that is substantially resistant to thermal degradation at the operating temperature of the aerosol-generating article. Suitable aerosol-formers are known in the art.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco. The solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

The solid aerosol-forming substrate may be provided on or embedded in a thermally stable carrier.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate. The one or more susceptors may be elongate and the one or more elongate susceptors may be positioned within the plug in direct or intimate physical contact with the aerosol-forming material.

The aerosol-forming substrate may have an external diameter of at least about 5 mm. The aerosol-forming substrate may have an external diameter of between about 5 mm and about 12 mm. In some embodiments, the aerosol-forming substrate may have an external diameter of 7.2 mm+/−10%.

The aerosol-forming substrate may have a length of between about 5 mm and about 15 mm. The elongate susceptor may be about the same length as the aerosol-forming substrate.

The aerosol-forming substrate may be substantially cylindrical.

The aerosol-generating article may also comprise a support element located immediately downstream of the aerosol-forming substrate. The support element may abut the aerosol-forming substrate.

The aerosol-generating article may also comprise an aerosol-cooling element located downstream of the aerosol-forming substrate, for example an aerosol-cooling element may be located immediately downstream of a support element and may abut the support element. The aerosol-cooling element may be located between the support element and a mouthpiece located at the extreme downstream end of the aerosol-generating article. The aerosol-cooling element may be termed a heat exchanger.

The aerosol-generating article may further comprise a mouthpiece located at the mouth end of the aerosol-generating article. The mouthpiece may be located immediately downstream of an aerosol-cooling element and may abut the aerosol-cooling element. The mouthpiece may comprise a filter. The filter may be formed from one or more suitable filtration materials. Many such filtration materials are known in the art. In one embodiment, the mouthpiece may comprise a filter formed from cellulose acetate tow.

The elements of the aerosol-generating article, for example the aerosol-forming substrate and any other elements of the aerosol-generating article such as a support element, an aerosol-cooling element and a mouthpiece, may be circumscribed by an outer wrapper. The outer wrapper may be formed from any suitable material or combination of materials. The outer wrapper may be a cigarette paper.

The aerosol-generating article may have an external diameter of between about 5 millimetres and about 12 millimetres, for example of between about 6 millimetres and about 8 millimetres. The aerosol-generating article may have an external diameter of 7.2 millimetres+/−10%.

The aerosol-generating article may have a total length of between about 30 millimetres and about 100 millimetres. The aerosol-generating article may have a total length of between 40 mm and 50 mm, for example about 45 millimetres.

According to a third aspect of the present invention, there is provided a method for operating an inductive heating device according to the first aspect of the present invention. The method comprises:

supplying power to the inductor from the DC power supply, via the DC/AC converter, for heating the susceptor of the aerosol-generating article when the aerosol-generating article is received by the inductive heating device, the supply of power being provided in a plurality of pulses separated by time intervals, the pulses comprising two or more heating pulses and one or more probing pulses between successive heating pulses; and controlling the duration of the time intervals between successive heating pulses based on one or more measurements of the current supplied from the DC power supply in one or more of the probing pulses.

In some embodiments, the method may comprise:

supplying power to the inductor in first heating pulse and a second heating pulse, separated from the first heating pulse by the time interval;

supplying power to the inductor in one or more probing pulses in the time interval between the first heating pulse and the second heating pulse;

measuring the current supplied from the DC power supply in one or more of the probing pulses; and determining the duration of the time interval between the first and second heating pulses based on measurements of current supplied from the DC power supply in the one or more probing pulses between the first and second heating pulses.

The method may comprise supplying one or more probing pulses in the time interval between the first and second heating pulses. Each probing pulse may have a duration substantially equal to the probing pulse duration. Where two or more probing pulses are supplied to the inductor, each successive probing pulse may be separated by a time interval substantially equal to the probing pulse time interval duration.

In an exemplary embodiment, the method may comprise:

supplying power to the inductor from the DC power supply in the first heating pulse;

interrupting the supply of power to the inductor to end the first heating pulse;

after a probing pulse time interval from the end of the first heating pulse has elapsed, supplying power to the inductor in a first probing pulse;

measuring the current supplied from the DC power supply in the first probing pulse;

after a probing pulse duration from the start of the first probing pulse has elapsed, interrupting the supply of power to the inductor to end the first probing pulse;

after the probing pulse time interval duration from the end of the first probing pulse has elapsed, supplying power to the inductor in a second probing pulse;

measuring the current supplied from the DC power supply in the second probing pulse; and after the probing pulse duration from the start of the second probing pulse has elapsed, interrupting the supply of power to the inductor to end the second probing pulse.

The method may comprise supplying power to the inductor from the DC power supply in a second heating pulse after the determined time interval has elapsed from the end of the first heating pulse. The method may comprise supplying power to the inductor from the DC power supply in the second heating pulse after the probing pulse time interval duration from the end of the final probing pulse in the series of probing pulses between the first and second heating pulses has elapsed.

The current supplied from the DC power supply in each probing pulse may be measured at any suitable time in the probing pulse. In some embodiments, the current may be measured at the start of the probing pulse. In some embodiments, the current in each probing pulse may be measured at the end of the probing pulse. In other words, the final current of each probing pulse may be measured. In some embodiments, two or more current measurements may be taken over each probing pulse.

In some embodiments, the determination of the duration of the time interval between first and second successive heating pulses may comprise: storing one or more target conditions on a memory of the power supply electronics; comparing the one or more measurements of the current supplied from the DC power supply in the one or more probing pulses to the one or more target conditions; and determining the duration of the time interval between the first and second heating pulses based on the comparison.

In some embodiments, the determination of the duration of the time interval between the first and second heating pulses further comprises: comparing one of more measurements of the current supplied from the DC power supply in the one or more probing pulses; and supplying power to the inductor in a second heating pulse if one or more of the measurements of current supplied from the DC power supply in the one or more probing pulses match a target condition.

In some embodiments, a target condition stored on the memory of the power supply electronics may comprise a series of conditions or targets. For example, in some embodiments, a target condition stored on the memory of the power supply electronics may comprise:

the current supplied from the DC power supply in a first pair of successive probing pulses decreases between the successive probing pulses;

the current supplied from the DC power supply in a second pair of successive probing pulses increases between the successive probing pulses; and the current supplied from the DC power supply at or after the second pair of successive probing pulses is equal to or greater than a reference current value.

In some embodiments, the method comprises: storing a reference maximum time interval on a memory of the power supply electronics; and supplying power to the inductor from the DC power supply in a second heating pulse when the reference maximum time interval has elapsed after the end of the first heating pulse.

In some embodiments, the method may comprise controlling the duration of the time intervals between successive heating pulses based on one or more measurements of the current supplied from the DC power supply and the voltage across the DC power supply in one or more of the probing pulses.

In these embodiments, the method may comprise:

determining a conductance value from one or more measurements of the current supplied from the DC power supply and the voltage across the DC power supply in one or more of the probing pulses;

determining one or more conductance values based on one or more of the measurements of current and voltage; and controlling the duration of the time interval between successive heating pulses based on more or more of the determined conductance values.

The one or more conductance values may be determined by calculating the quotient of one or more of the measurements of current and one or more of the measurements of voltage.

According to a fourth aspect of the present invention, there is provided a method for operating an inductive heating device according to the first aspect of the present invention, wherein the inductive heating device is configured to receive an aerosol-generating article comprising a susceptor comprising a first susceptor material and a second susceptor material, the first susceptor material being disposed in thermal proximity to the second susceptor material, and the second susceptor material having a Curie temperature that is lower than 500° C. The method comprises:

supplying power to the inductor from the DC power supply via the DC/AC converter for heating the susceptor of the aerosol-generating article in a first heating pulse, when the aerosol-generating article is received by the inductive heating device;

determining when the current supplied from the DC power supply is at a minimum current value;

determining when the current supplied from the DC power supply is at a maximum current value;

interrupting the supply of power from the DC power supply to the inductor when the maximum current value is determined to end the first heating pulse;

after a probing pulse time interval has elapsed from the end of the first heating pulse, suppling power to the inductor from the DC power supply in one or more probing pulses, each probing pulse having a duration substantially equal to a probing pulse duration and successive probing pulses being separated by time intervals having a duration substantially equal to the probing pulse time interval duration;

measuring the current supplied from the DC power supply in each probing pulse;

determining the time interval between the first and second heating pulses based on one or more measurements of current supplied from the DC power supply in one or more of the probing pulses; and supplying power to the inductor from the DC power supply in the second heating pulse when the determined time interval has elapsed after the end of the first heating pulse.

In some embodiments, the determination of the time interval between the first and second heating pulses comprises: storing one or more target conditions on a memory of the power supply electronics; and comparing the one or more measurements of current supplied from the DC power supply in the one or more probing pulses.

In some embodiments, a target condition stored on the memory of the power supply electronics is a reference current, and the method comprises supplying power to the inductor from the DC power supply in a second heating pulse if the one or more measurements of current are equal to or greater than the reference current.

In some embodiments, a target condition stored on the memory of the power supply electronics may comprise a sequence or a series of conditions or targets. The power supply electronics may be configured to compare successive measurements of current from successive probing pulses to each of the series or sequence of target conditions in order. For example, in some embodiments, a sequence of target conditions stored on the memory of the power supply electronics may comprise:

- the current supplied from the DC power supply in a first pair of successive probing pulses decreases between the successive probing pulses;
- the current supplied from the DC power supply in a second pair of successive probing pulses increases between the successive probing pulses; and
- the current supplied from the DC power supply at or after the second pair of successive probing pulses is equal to or greater than a reference current value.

In some embodiments, the reference current value may be the minimum current value of the first heating pulse. In these embodiments, the method may comprise storing the minimum current value of the first heating pulse as a target condition.

According to a fifth aspect of the present invention there is provided a control system for an inductive heating device according to the first aspect of the present invention. The control system may comprise a microcontroller programmed to perform any of the method steps according to the third or fourth aspects of the present invention.

It will be appreciated that features described in relation to one aspect of the invention may be applied to any other aspects of the invention, either alone or in combination with other described aspects and features of the invention.

It will be appreciated that whenever the term "about" is used herein in connection with a particular value, the value following the term "about" does not have to be exactly the particular value due to technical considerations. However, the term "about" used herein in connection with a particular value is to be understood to include and also to explicitly disclose the particular value following the term "about".

Features described in relation to one aspect or embodiment may also be applicable to other aspects and embodiments.

FIG. 1A and FIG. 1B illustrate a specific example of a unitary multi-material susceptor for use in an aerosol-generating article of an aerosol-generating system according to an embodiment of the present invention. The susceptor 1 is in the form of an elongate strip having a length of 12 mm and a width of 4 mm. The susceptor is formed from a first susceptor material 2 that is intimately coupled to a second susceptor material 3. The first susceptor material 2 is in the form of a strip of grade 430 stainless steel having dimensions of 12 mm by 4 mm by 35 micrometres. The second susceptor material 3 is a patch of nickel of dimensions 3 mm by 2 mm by 10 micrometres. The patch of nickel has been electroplated onto the strip of stainless steel. Grade 430 stainless steel is a ferromagnetic material having a Curie temperature in excess of 400° C. Nickel is a ferromagnetic material having a Curie temperature of about 354° C.

It will be appreciated that in other embodiments of the invention, the material forming the first and second susceptor materials may be varied. It will also be appreciated that in other embodiments of the invention there may be more than one patch of the second susceptor material located in intimate physical contact with the first susceptor material.

Figure 2:
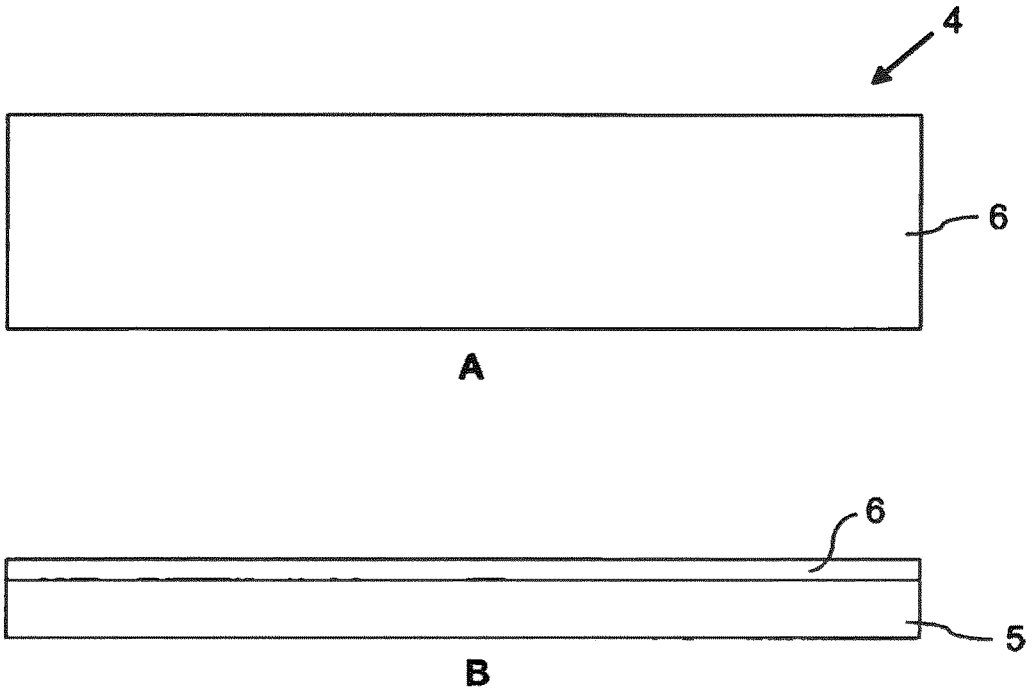
FIG. 2A is a plan view of a another susceptor for use in an aerosol-generating article of an aerosol-generating system according to another embodiment of the present invention.
FIG. 2B is a side view of the susceptor of FIG. 2A.

FIG. 2A and FIG. 2B illustrate a second specific example of a unitary multi-material susceptor for use in an aerosol-generating article of an aerosol-generating system according to another embodiment of the present invention. The susceptor 4 is in the form of an elongate strip having a length of 12 mm and a width of 4 mm. The susceptor is formed from a first susceptor material 5 that is intimately coupled to a second susceptor material 6. The first susceptor material 5 is in the form of a strip of grade 430 stainless steel having dimensions of 12 mm by 4 mm by 25 micrometres. The second susceptor material 6 is in the form of a strip of nickel having dimensions of 12 mm by 4 mm by 10 micrometres. The susceptor is formed by cladding the strip of nickel 6 to the strip of stainless steel 5. The total thickness of the susceptor is 35 micrometres. The susceptor 4 of FIG. 2 may be termed a bi-layer or multilayer susceptor.

Figure 3:
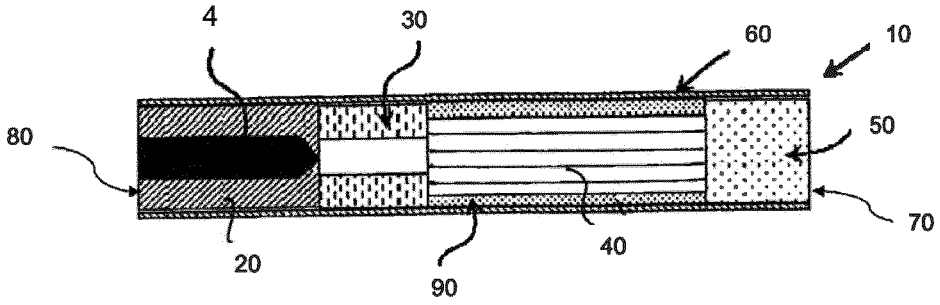
FIG. 3 is a schematic cross-sectional illustration of a specific embodiment of an aerosol-generating article incorporating a susceptor as illustrated in FIGS. 2A and 2B.

FIG. 3 illustrates an aerosol-generating article 10 of an aerosol-generating system according to an embodiment of the present invention. The aerosol-generating article 10 comprises four elements arranged in coaxial alignment: an aerosol-forming substrate 20, a support element 30, an aerosol-cooling element 40, and a mouthpiece 50. Each of these four elements is a substantially cylindrical element, each having substantially the same diameter. These four elements are arranged sequentially and are circumscribed by an outer wrapper 60 to form a cylindrical rod. An elongate bi-layer susceptor 4 is located within the aerosol-forming substrate, in intimate physical contact with the aerosol-forming substrate. The susceptor 4 is the susceptor described above in relation to FIG. 2. The susceptor 4 has a length (12 mm) that is about the same as the length of the aerosol-forming substrate, and is located along a radially central axis of the aerosol-forming substrate.

The aerosol-generating article 10 has a proximal or mouth end 70, which a user inserts into his or her mouth during use, and a distal end 80 located at the opposite end of the aerosol-generating article 10 to the mouth end 70. Once assembled, the total length of the aerosol-generating article 10 is about 45 mm and the diameter is about 7.2 mm.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or downstream of the distal end 80.

The aerosol-forming substrate 20 is located at the extreme distal or upstream end 80 of the aerosol-generating article 10. In the embodiment illustrated in FIG. 3, the aerosol-forming substrate 20 comprises a gathered sheet of crimped homogenised tobacco material circumscribed by a wrapper. The crimped sheet of homogenised tobacco material comprises glycerine as an aerosol-former.

The support element 30 is located immediately downstream of the aerosol-forming substrate 20 and abuts the aerosol-forming substrate 20. In the embodiment shown in FIG. 3, the support element is a hollow cellulose acetate tube. The support element 30 locates the aerosol-forming substrate 20 at the extreme distal end 80 of the aerosol-generating article. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 3, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 3, the mouthpiece 50 comprises a conventional cellulose acetate tow filter of low filtration efficiency.

To assemble the aerosol-generating article 10, the four cylindrical elements described above are aligned and tightly wrapped within the outer wrapper 60. In the embodiment illustrated in FIG. 3, the outer wrapper is a conventional cigarette paper. The susceptor 4 may be inserted into the aerosol-forming substrate 20 during the process used to form the aerosol-forming substrate, prior to the assembly of the plurality of elements to form a rod.

The specific embodiment described in relation to FIG. 3 comprises an aerosol-forming substrate formed from homogenised tobacco. However, it will be appreciated that in other embodiments the aerosol-forming substrate may be formed from different material. For example, a second specific embodiment of an aerosol-generating article has elements that are identical to those described above in relation to the embodiment of FIG. 3, with the exception that the aerosol-forming substrate 20 is formed from a non-tobacco sheet of cigarette paper that has been soaked in a liquid formulation comprising nicotine pyruvate, glycerine, and water. The cigarette paper absorbs the liquid formulation and the non-tobacco sheet thus comprises nicotine pyruvate, glycerine and water. The ratio of glycerine to nicotine is 5:1. In use, the aerosol-forming substrate 20 is heated to a temperature of about 220 degrees Celsius. At this temperature an aerosol comprising nicotine pyruvate, glycerine, and water is evolved and may be drawn through the filter 50 and into the user's mouth. It is noted that the temperature that the substrate 20 is heated to is considerably lower than the temperature that would be required to evolve an aerosol from a tobacco substrate. As such, in such an embodiment the second susceptor material may be a material having a lower Curie temperature than Nickel. An appropriate Nickel alloy may, for example, be selected.

The aerosol-generating article 10 illustrated in FIG. 3 is designed to engage with an electrically-operated aerosol-generating device comprising an induction coil, or inductor, in order to be consumed by a user.

Figure 4:
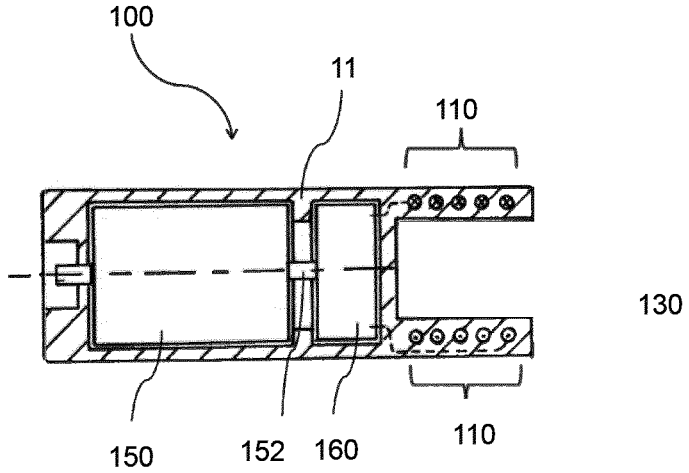
FIG. 4 is a schematic cross-sectional illustration of a specific embodiment of an electrically-operated aerosol-generating device for use with the aerosol-generating article illustrated in FIG. 3.

A schematic cross-sectional illustration of an electrically-operated aerosol-generating device 100 is shown in FIG. 4. The aerosol-generating device 100 is an inductive heating device according to the present invention. The electrically-operated aerosol-generating device 100 comprises a substantially circularly cylindrical housing 11 that substantially contains the components of the device. The aerosol-generating device 100 comprises an inductor 110. As shown in FIG. 4, the inductor 110 is located adjacent a distal portion 131 of a substrate receiving chamber 130 of the aerosol-generating device 100. In use, the user inserts an aerosol-generating article 10 into the substrate receiving chamber 130 of the aerosol-generating device 100 such that the aerosol-forming substrate 20 of the aerosol-generating article 10 is located adjacent to the inductor 110.

The aerosol-generating device 100 comprises a battery 150 and power supply electronics 160 that allow the inductor 110 to be actuated. Such actuation may be manually operated or may occur automatically in response to a user drawing on an aerosol-generating article 10 inserted into the substrate receiving chamber 130 of the aerosol-generating device 100. The battery 150 is a DC power supply, and supplies a current and a DC voltage. The power supply electronics 160 include a DC/AC converter or inverter 162 for supplying the inductor 110 with a high frequency AC current, as described in more detail later on. The battery 150 is electrically connected to the power supply electronics through a suitable electrical connection 152.

Figure 5:
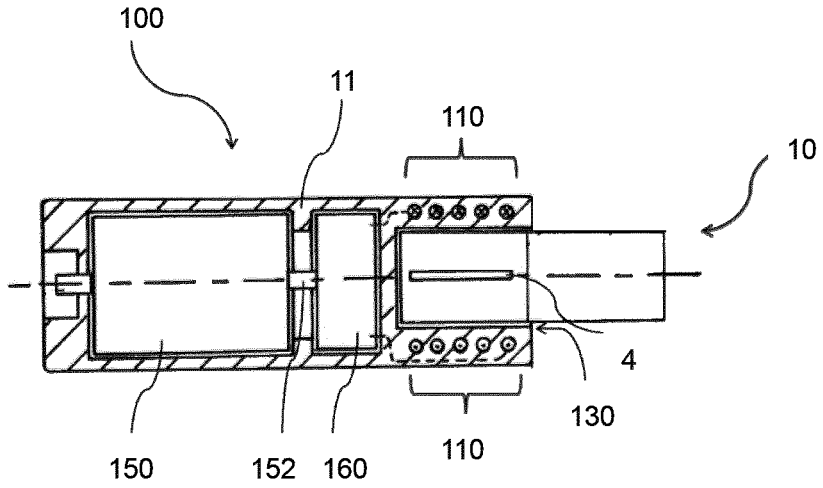
FIG. 5 is a schematic cross-sectional illustration of the aerosol-generating article of FIG. 3 in engagement with the electrically-operated aerosol-generating device of FIG. 4.

FIG. 5 illustrates the aerosol-generating article 10 in engagement with the electrically-operated aerosol-generating device 100. When the device 100 is actuated, a high-frequency alternating current is passed through coils of wire that form part of the inductor 110. This causes the inductor 110 to generate a fluctuating electromagnetic field within the distal portion 131 of the substrate receiving cavity 130 of the device. The electromagnetic field may fluctuate with a frequency of between about 1 MHz and about 30 MHz, between about 2 MHz and about 10 MHz or between about 5 MHz and about 7 MHz. When an aerosol-generating article 10 is correctly located in the substrate receiving cavity 130, the susceptor 4 of the article 10 is located within this fluctuating electromagnetic field. The fluctuating field generates eddy currents within the susceptor, which raises the temperature of the susceptor 4. Further heating is provided by magnetic hysteresis losses within the susceptor 4. Heat is transferred from the heated susceptor 4 to the aerosol-forming substrate 20 of the aerosol-generating article 10 primarily by conduction. The heated susceptor 4 heats the aerosol-forming substrate 20 to a sufficient temperature to form an aerosol. The aerosol is drawn downstream through the aerosol-generating article 10 and is inhaled by the user.

Figure 6:
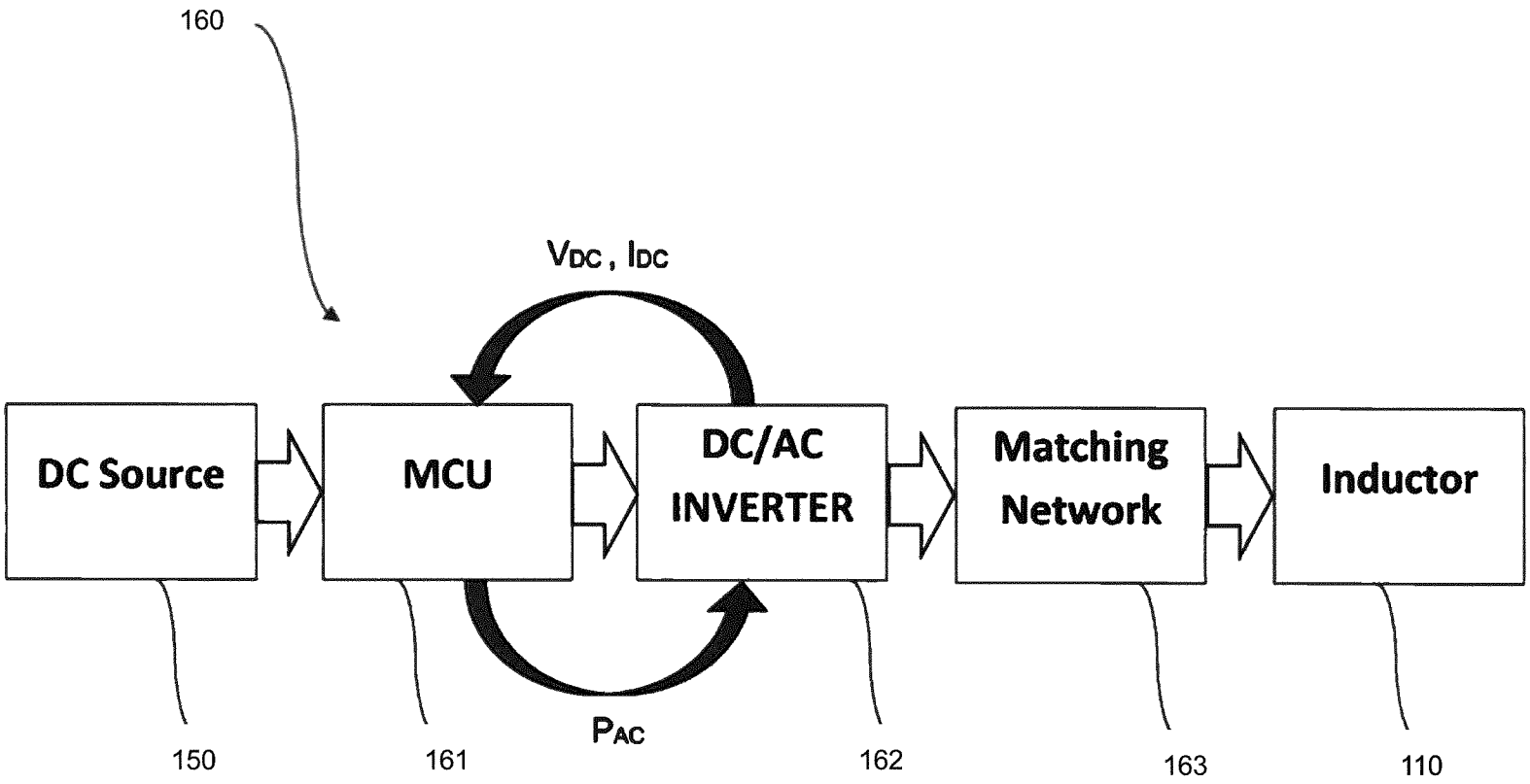
FIG. 6 is a block diagram showing electronic components of the aerosol-generating device described in relation to FIG. 4.

FIG. 6 is a block diagram showing electronic components of the aerosol-generating device 100 described in relation to FIG. 4. The aerosol-generating device 100 comprises the DC power supply 150 (the battery), a microcontroller (microprocessor control unit) 161, a DC/AC converter or inverter 162, a matching network 163 for adaptation to the load, and the inductor 110. The microprocessor control unit 161, DC/AC converter or inverter 162 and matching network 163 are all part of the power supply electronics 160. The DC supply voltage VDC and the current IDC drawn from the DC power supply 150 are provided by feed-back channels to the microprocessor control unit 161. This may be by measurement of both the DC supply voltage $V_{DC}$ and the current $I_{DC}$ drawn from the DC power supply 150 to control the further supply of AC power $P_{AC}$ to the inductor 110.

It will be appreciated that the matching network 163 may be provided for optimum adaptation of the power supply electronics 160 to the load of the aerosol-generating article 10, but it is not essential. In other embodiments, the electronics may not be provided with a matching network.

Figure 7:
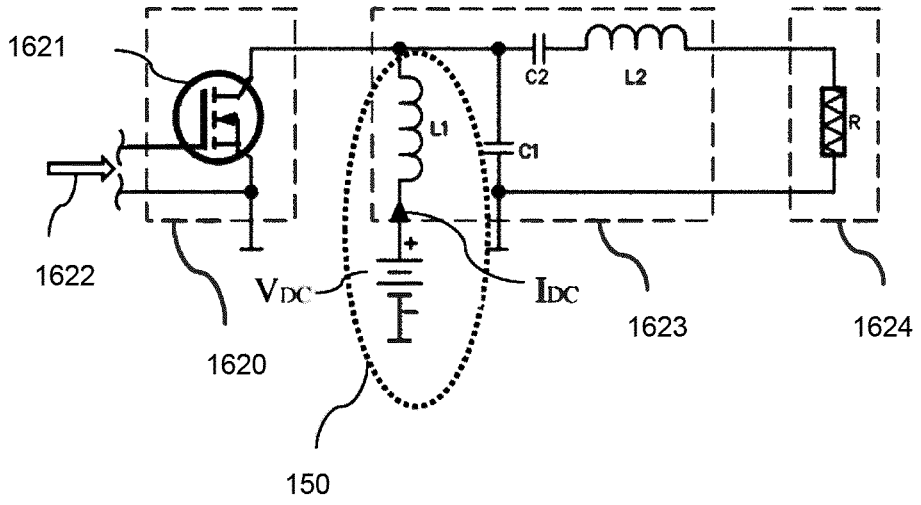
FIG. 7 is a schematic diagram of components of the power electronics of the inductive heating device of FIG. 3.
Figure 8:
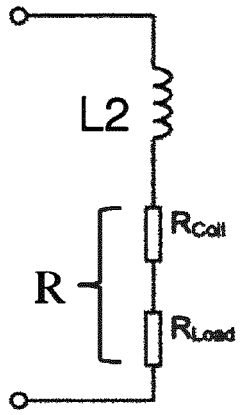
FIG. 8 is a schematic diagram of an inductor of an LC load network of the power electronics of FIG. 7, comprising the inductivity and ohmic resistance of the load.

FIG. 7 shows some components of the power supply electronics 160, more particularly of the DC/AC converter 162. As can be seen from FIG. 7, the DC/AC converter 162 comprises a Class-E power amplifier comprising a transistor switch 1620 comprising a Field Effect Transistor (FET) 1621, for example a Metal-Oxide-Semiconductor Field Effect Transistor (MOSFET), a transistor switch supply circuit indicated by the arrow 1622 for supplying the switching signal (gate-source voltage) to the FET 1621, and an LC load network 1623 comprising a shunt capacitor C1 and a series connection of a capacitor C2 and inductor L2. In addition, the DC power supply 150 comprising a choke L1 is shown for supplying a DC supply voltage $V_{DC}$, with a current $I_{DC}$ being drawn from the DC power supply 150 during operation. The ohmic resistance R representing the total ohmic load 1624, which is the sum of the ohmic resistance $R_{Coil}$ of the inductor L2 and the ohmic resistance $R_{Load}$ of the susceptor 4, is shown in FIG. 8.

The general operating principle of the Class-E power amplifier are known and are described in detail in the article "Class-E RF Power Amplifiers", Nathan O. Sokal, published in the bimonthly magazine QEX, edition January/February 2001, pages 9-20, of the American Radio Relay League (ARRL), Newington, Conn., U.S.A. and in WO-A1-2015/177255, WO-A1-2015/177256 and WO-A1-2015/177257 mentioned earlier.

Due to the very low number of components the volume of the power supply electronics 160 can be kept extremely small. For example, the volume of the power supply electronics may be equal or smaller than 2 $cm^3$. This extremely small volume of the power supply electronics is possible due to the inductor L2 of the LC load network 1623 being directly used as the inductor 110 for the inductive coupling to the susceptor 4 of aerosol-forming article, and this small volume allows for keeping the overall dimensions of the entire device 1 small. In embodiments where a separate inductor, other than the inductor L2, is used for the inductive coupling to the susceptor 21, this would necessarily increase the size of the power supply electronics. The size of the power supply electronics is also increased by the provision of a matching network 163.

During operation of the electrically operated aerosol-generating system, the inductor 100 generates a high frequency alternating magnetic field that induces eddy currents in the susceptor 4. As the susceptor 4 of the aerosol-generating article 10 is heated during operation, the apparent resistance ($R_a$) of the susceptor increases as the temperature of the susceptor 110 increases. This increase in the apparent resistance $R_a$ is remotely detected by the power supply electronics 160 through measurements of the current $I_{DC}$ drawn from the DC power supply 150, which at constant voltage decreases as the temperature and apparent resistance $R_a$ of the susceptor increases.

The high frequency alternating magnetic field provided by the inductor 110 induces eddy currents in close proximity to the susceptor surface. The resistance in the susceptor depends in part on the electrical resistivities of the first and second susceptor materials and in part on the depth of the skin layer in each material available for induced eddy currents. As the second susceptor material 6 (Nickel) reaches its Curie temperature it loses its magnetic properties. This causes an increase in the skin layer available for eddy currents in the second susceptor material 6, which causes a decrease in the apparent resistance of the susceptor. This results in a temporary increase in the detected current $I_{DC}$ drawn from the DC power supply 150 when the second susceptor material reaches its Curie point. This can be seen in the graph of FIG. 9.

The power supply electronics 160 are configured to supply a series of successive pulses of power to the inductor 110 from the power supply 150. In particular, the power supply electronics 160 are configured to supply power to the inductor 110 in a series of heating pulses separated by time intervals and in a plurality of series of probing pulses, each series of probing pulses being supplied to the inductor in one of the time intervals between successive heating pulses.

Figure 10:
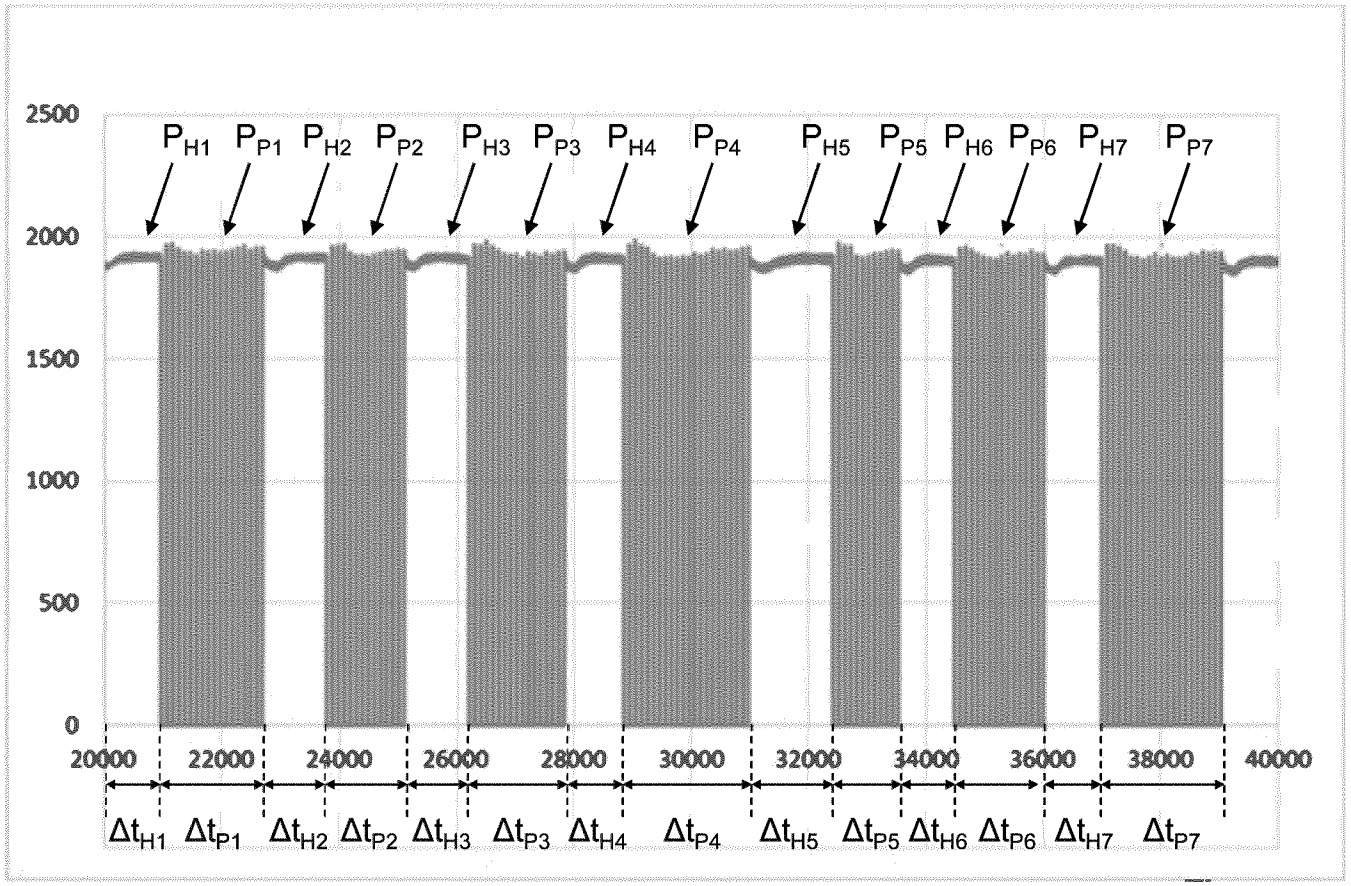
FIG. 10 is a graph of current vs. time showing control of the duration of the time period between successive heating pulses based on measurements of current of probing pulses between the heating pulses, in accordance with the present invention.

FIG. 10 shows a graph of a series of successive pulses of power supplied from the DC power supply 150 to the inductor 110 during operation of the device 1. In particular, FIG. 10 shows a series of heating pulses $P_{H1}$ to $P_{H7}$ separated by time intervals $\Delta t_{H1}$ to $\Delta t_{H7}$ and a plurality of series of probing pulses $P_{H1}$ to $P_{H7}$. As shown in FIG. 10, a series of probing pulses $P_{PN}$ is supplied to the inductor 110 in each time interval $\Delta t_{HN}$ between a successive pair of heating pulses $P_{HN}$, $P_{HN+1}$ in the series.

It can be seen from FIG. 10 that the duration of each of the heating pulses $P_{HN}$, the duration of each of the time intervals $\Delta t_{HN}$ between successive heating pulses $P_{HN}$, $P_{HN+1}$ and the number of probing pulses between successive heating pulses are variable (i.e. are not fixed). The duration of all of these aspects depends on measurements of current supplied by the DC power supply 150 in the pulses, as described in more detail below.

As described above, the current supplied by the DC power supply 150 to the inductor 110 is indicative of the temperature of the susceptor 4 coupled to the inductor 110. The power supply electronics 160 are configured to measure the current supplied from the DC power supply 150 to the inductor 110.

The power supply electronics 160 are generally configured to control the duration of each of the heating pulses $P_{HN}$ by determining a maximum current $I_{DCMAX}$ for each heating pulse. The maximum current $I_{DCMAX}$ is indicative of the susceptor 4 being above the second Curie temperature and the phase transition of the second susceptor material having taken place. As such, on detection of the DC power supply 150 supplying the maximum current $I_{DCMAX}$, the power supply electronics 160 is configured to interrupt the supply of power from the DC power supply 150 to the inductor 110 to end the heating pulse. This avoids overheating of the aerosol-forming substrate in the aerosol-generating article 10 by the susceptor 4.

In some embodiments, the power supply electronics 160 may also be configured to determine a minimum current $I_{DCMIN}$ for each heating pulse. The power supply electronics 160 may be further configured to store the determined minimum current $I_{DCMIN}$ for use as a reference current value, as described in more detail later on.

At the end of each heating pulse $P_{HN}$, the power supply electronics 160 are configured to supply power to the inductor 110 from the DC power supply 150 in a series of probing pulses $P_{PN}$. At the end of each heating pulse $P_{HN}$, the power supply electronics 160 are configured to supply a first probing pulse $P_{PN,1}$ of a series of probing pulses $P_{PN}$. The power supply electronics 160 are configured to supply power to the inductor 110 in the first probing pulse $P_{PN,1}$ after a probing pulse time interval duration $\Delta t_{PI}$ has elapsed from the end of the heating pulse $P_{HN}$. The power supply electronics 160 are configured to supply power to the inductor 110 for a probing pulse duration $\Delta t_P$. The probing pulse duration $\Delta t_P$ and the probing pulse time interval duration $\Delta t_{PI}$ are stored in a memory of the power supply electronics. In this embodiment, the probing pulse duration $\Delta t_P$ is about 10 milliseconds and the probing pulse time interval duration $\Delta t_{PI}$ is about 90 milliseconds.

After the probing pulse duration $\Delta t_P$ has elapsed, the power supply electronics 160 are configured to measure the current $I_{PN,1}$ being supplied from the DC power supply 150. After the current measurement has been taken, the power supply electronics 160 are configured to interrupt the supply of power from the DC power supply 150 to end the first probing pulse $P_{PN,1}$.

The power supply electronics 160 are further configured to compare the measured current $I_{PN,1}$ to one or more target conditions stored in a memory of the power supply electronics. The power supply electronics 160 are configured to continue to supply power to the inductor 110 in a series of probing pulses $P_{PN,N}$ until the current measured in the probing pulses matches the target conditions or until the time interval after the heating pulse reaches a predetermined maximum value, as described in more detail below.

Figure 11:
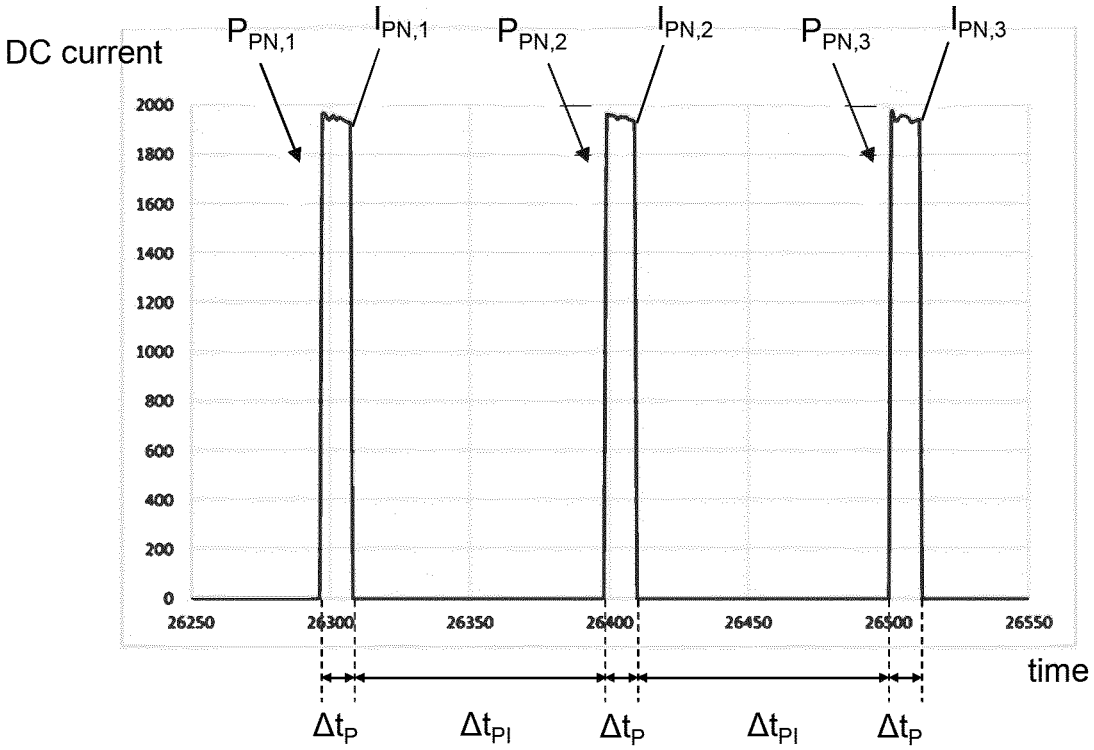
FIG. 11 is a graph of current vs. time showing a plurality of probing pulses between successive heating pulses.

The power supply electronics 160 are configured such that all probing pulses $P_{PN,N}$ in a series of probing pulses $P_{PN}$ have the same duration (i.e. the probing pulse duration $\Delta t_P$) and successive probing pulses in the series are separated the same time interval (i.e. the probing pulse time interval $\Delta t_{PI}$). Furthermore, the power supply electronics are configured such that the current is measured at each probing pulse at the same point in the probing pulse, which in this embodiment is at the end of the probing pulse. FIG. 11 shows three probing pulses $P_{PN,1}$, $P_{PN,2}$ and $P_{PN,3}$ of a series of probing pulses $P_{PN}$, between two successive heating pulses $P_{HN}$, $P_{HN+1}$, in greater detail than FIG. 10.

The power supply electronics 160 are configured to compare the measurements of the current $I_{PN,N}$ in each probing pulse $P_{PN,N}$ in the series of probing pulses $P_{PN}$ to one or more target conditions. In this embodiment, a sequence of target conditions is stored in a memory of the power supply electronics 160. A first condition of the stored sequence of target conditions is that the current measurements for a first pair of successive probing pulses decreases between the successive probing pulses. A second condition of the stored sequence of target conditions is that the current measurement for a second pair of successive probing pulses increases between the successive probing pulses. When this sequence of current measurements occurs in the series of probing pulses, it indicates that the current measured in the probing pulses has reached a minimum value in the series, which indicates that the susceptor 4 has cooled sufficiently after the previous heating pulse for the next heating pulse in the series to be initiated. Accordingly, in this embodiment, at least three probing pulses are required before the sequence of target conditions may be satisfied. The power supply electronics may be configured to allow the susceptor to cool to any suitable temperature. Typically, the power supply electronics are configured to allow the susceptor to cool to about 250° C.

An example of a series of probing pulses $P_{PN}$ that satisfies the target conditions may be provided using the probing pulses shown in FIG. 11. A current $I_{PN,1}$ measured in a first probing pulse $P_{PN,1}$ may be larger than a current $I_{PN,2}$ measured in a second successive probing pulse $P_{PN,2}$. This represents a decrease in the current between a first pair of successive probing pulses and satisfies the first condition of the sequence. The current $I_{PN,2}$ measured in the second probing pulse $P_{PN,2}$ may be smaller than the current $I_{PN,3}$ measured in a third successive probing pulse $I_{PN,3}$. This represents an increase in the current between a second pair of successive probing pulses and satisfies the second and final condition of the sequence. As such, after a period of time substantially equal to the probing pulse time interval duration $\Delta t_{PI}$ has elapsed from the end of the second probing pulse $P_{PN,2}$, the power supply electronics 160 may be configured to supply power to the inductor 110 in the next successive heating pulse $P_{HN+1}$ in the series.

In this embodiment, the duration of the time interval $\Delta t_{HN}$ between successive heating pulses $P_{HN}$, $P_{HN}$+1 is substantially equal to the sum of the duration of each of the probing pulses $\Delta t_P$ and the probing pulse time intervals $\Delta t_{PI}$ between the successive heating pulses $P_{HN}$, $P_{HN+1}$.

The current measured in each probing pulse is affected by the temperature of the susceptor 4 coupled to the inductor 110. As such, the one or more target conditions may be set such that the temperature of the susceptor 4 is optimal for aerosol-generation at the start of the next heating pulse in the series. In this embodiment, a longer time interval between successive heating pulses results in a larger number of probing pulses being generated between the successive heating pulses before the target condition is met A predetermined maximum time interval duration is also stored in a memory of the power supply electronics 160. The power supply electronics 160 are configured to monitor the duration of the time interval after the end of a heating pulse, and compare the time interval duration to the predetermined maximum time interval duration. When the time interval duration is substantially equal to or greater than the predetermined maximum time interval duration, the power supply electronics 160 are configured to supply power to the inductor 110 in the next heating pulse in the series. In this embodiment, the predetermined maximum time interval duration is about 4.5 s. As such, the maximum time interval between successive heating pulses is about 4.5 s.

Monitoring the temperature of the susceptor 4 as the susceptor is allowed to cool in the time intervals between the heating pulses by monitoring the current in the probing pulses enables the power supply electronics 160 to actively adjust the heating of the susceptor to compensate for unexpected changes in the temperature of the susceptor. Unexpected changes in the temperature of the susceptor may occur for a number of reasons. For example, the susceptor may be cooled rapidly if a user takes several rapid puffs on the aerosol-generating article, which may require the power supply electronics 160 to provide a relatively short time interval between successive heating pulses to raise or maintain the temperature of the susceptor within a desired temperature range. Conversely, in another example the power supply electronics 160 may be required to provide a relatively long time interval between successive heating pulses if a user is not puffing on the aerosol-generating article, such that the susceptor is cooling at a slower rate over the time intervals between successive heating pulses.

It will be appreciated that in other embodiments, the measurements of current taken in the probing pulses may be compared to other target conditions. In particular, in some embodiments, the power supply electronics 160 may be configured to compare the measurements of the current $I_{PN,N}$ in each probing pulse $P_{PN,N}$ in the series of probing pulses $P_{PN}$ to the first and second conditions mentioned above and also to a third and final condition. The third condition may be that the current measured at or after the second pair of successive probing pulses is equal to or greater than a reference current value. The reference current value may be the minimum current $I_{DCMIN}$ determined for the previous heating pulse and stored in a memory of the power supply electronics 160. When the measured current value is substantially equal to the minimum current $I_{DCMIN}$ determined for the previous heating pulse (i.e. the stored reference current value), this may provide a further indication that the susceptor 4 has cooled sufficiently after the previous heating pulse for the next heating pulse in the series to be initiated.

An example of a series of probing pulses $P_{PN}$ that satisfies the target conditions may again be provided using the probing pulses shown in FIG. 11. In this example, the current $I_{PN,3}$ measured in the third probing pulse $P_{PN,3}$ may be larger than the reference maximum current stored in a memory of the power supply electronics 160. In this example, this would satisfy the third and final condition in the sequence of target conditions and the power supply electronics 160 may be configured to supply power to the inductor 110 in the next successive heating pulse in the series after the probing pulse time interval has elapsed.

The exemplary embodiments described above are not intended to limit the scope of the claims. Other embodiments consistent with the exemplary embodiments described above will be apparent to those skilled in the art.

For example, in some embodiments the power supply electronics may be configured to measure the current supplied from the DC power supply and the voltage across the DC power supply in one or more of the probing pulses, determine one or more conductance values based on one or more of the measurements of current and voltage and control the duration of the time interval between successive heating pulses based on more or more of the determined conductance values. The power supply electronics may be configured to determine a conductance value by calculating the quotient of a current measurement and a voltage measurement. In some embodiments, the power supply electronics may be configured to compare the one or more determined conductance values to one or more target conditions and control the duration of the time interval between successive heating pulses based on the comparison.

The invention claimed is:

1. An inductive heating device configured to receive an aerosol-generating article comprising an aerosol-forming substrate and a susceptor, the inductive heating device being further configured to heat the susceptor when the aerosol-generating article is received by the inductive heating device, the inductive heating device comprising:

a DC power supply configured to provide a DC supply voltage and a current; and power supply electronics comprising:

a DC/AC converter connected to the DC power supply, and an inductor connected to the DC/AC converter and configured to inductively couple to the susceptor of the aerosol-generating article when the aerosol-generating article is received by the inductive heating device, wherein the power supply electronics are configured to:

supply power to the inductor from the DC power supply, via the DC/AC converter, for heating the susceptor of the aerosol-generating article when the aerosol-generating article is received by the inductive heating device, the supply of power being provided in a plurality of pulses separated by time intervals, the plurality of pulses comprising two or more heating pulses and one or more probing pulses between successive heating pulses, and control a duration of a time interval between the successive heating pulses based on one or more measurements of the current supplied from the DC power supply in one or more of the one or more probing pulses.

2. The inductive heating device according to claim 1, wherein:

the heating pulses comprise at least a first heating pulse and a second heating pulse, separated from the first heating pulse by the time interval, and the power supply electronics are further configured to supply power to the inductor from the DC power supply in the one or more probing pulses in the time interval between the first heating pulse and the second heating pulse, and control the duration of the time interval between the first and the second heating pulses based on measurements of the current supplied from the DC power supply in one or more of the one or more probing pulses.

3. The inductive heating device according to claim 1, wherein the power supply electronics are further configured to compare the one or more measurements of the current supplied from the DC power supply in the one or more probing pulses to one or more target conditions.

4. The inductive heating device according to claim 3, wherein the power supply electronics are further configured to:

supply power to the inductor from the DC power supply in a first heating pulse, interrupt the supply of power to the inductor to end the first heating pulse, after a probing pulse time interval from an end of the first heating pulse has elapsed, supply power to the inductor in a first probing pulse, measure a current supplied from the DC power supply in the first probing pulse, after a probing pulse duration from a start of the first probing pulse has elapsed, interrupt the supply of power to the inductor to end the first probing pulse, compare one of more measurements of the current in the first probing pulse to one or more target conditions, and supply power to the inductor from the DC power supply in a second heating pulse if one or more of the measurements of current match a target condition.

5. The inductive heating device according to claim 4, wherein if the one or more measurements of current in the first probing pulse do not match the target condition, the power supply electronics are further configured to:

after the probing pulse time interval from the end of the first probing pulse has elapsed, supply power to the inductor in a second probing pulse, measure a current supplied from the DC power supply in the second probing pulse, after a probing pulse duration from a start of the second probing pulse has elapsed, interrupt the supply of power to the inductor to end the second probing pulse, compare one or more measurements of the current in the second probing pulse to one or more of the target conditions, and supply power to the inductor in the second heating pulse if one or more of the measurements of current in the one or more probing pulses matches the target condition.

6. The inductive heating device according to claim 3, wherein the power supply electronics are further configured to:

supply power to the inductor from the DC power supply in a series of probing pulses, wherein each probing pulse has a duration substantially equal to a probing pulse duration and successive probing pulses are separated by time intervals substantially equal to a probing pulse time interval, measure a current in each of the probing pulses in the series, and supply power to the inductor in a second heating pulse when one or more of the measurements of current in the probing pulses matches a target condition.

7. The inductive heating device according to claim 3, wherein one of the one or more target conditions comprises a reference value and the power supply electronics are further configured to supply power to the inductor in a second heating pulse if one or more of the measurements of current in the one or more probing pulses is substantially equal to or greater than the reference value.

8. The inductive heating device according claim 6, wherein the power supply electronics are further configured to determine that the current measured in the series of probing pulses is a minimum current in the series of probing pulses and supply power to the inductor in the second heating pulse if the minimum current in the series of probing pulses is determined to have occurred.

9. The inductive heating device according claim 6, wherein one of the one or more target conditions comprises a sequence of conditions, including:

measurements of the current supplied from the DC power supply in a first pair of successive probing pulses decrease between the successive probing pulses, measurements of the current supplied from the DC power supply in a second pair of successive probing pulses increase between the successive probing pulses, and a measurement of current supplied at or after the second pair of successive probing pulses is greater than or equal to a reference current value.

10. The inductive heating device according claim 1, wherein the inductive heating device is further configured to receive the aerosol-generating article comprising the susceptor comprising a first susceptor material and a second susceptor material, the first susceptor material being disposed in thermal proximity to the second susceptor material, and the second susceptor material having a Curie temperature that is lower than 500° C., and wherein for each heating pulse, the power supply electronics are further configured to:

determine when the current supplied from the DC power supply is at a maximum current value, and interrupt the supply of power from the DC power supply to the inductor when the maximum current value is determined.

11. The inductive heating device according claim 1, wherein the power supply electronics are further configured to supply two or more probing pulses between the successive heating pulses and each probing pulse has a substantially similar duration.

12. The inductive heating device according claim 1, wherein the power supply electronics are further configured to supply two or more probing pulses between the successive heating pulses, and wherein successive probing pulses are separated by a probing pulse time interval, each probing pulse time interval having a substantially similar duration.

13. The inductive heating device according claim 1, wherein the power supply electronics are further configured to control the duration of the time interval between the successive heating pulses based on the more or more measurements of the current supplied from the DC power supply and a voltage across the DC power supply in one or more of the probing pulses.

14. The inductive heating device according claim 13, wherein the power supply electronics are configured to:

determine one or more conductance values from one or more measurements of the current supplied from the DC power supply and the voltage across the DC power supply in one or more of the probing pulses, and control the duration of the time interval between the successive heating pulses based on the more or more of the determined conductance values.

15. An aerosol-generating system, comprising:

an inductive heating device according to claim 1; and an aerosol-generating article comprising an aerosol-forming substrate and a susceptor, the inductive heating device being configured to receive the susceptor and to heat the susceptor when the aerosol-generating article is received by the inductive heating device.

16. The aerosol-generating system comprising according to claim 15, wherein the inductive heating device further comprises an aerosol-generating article comprising a susceptor comprising a first susceptor material and a second susceptor material, the first susceptor material being disposed in intimate physical contact with the second susceptor material, and the second susceptor material having a Curie temperature that is lower than 500° C.

17. A method for operating an inductive heating device according to claim 1, the method comprising:

supplying power to the inductor from the DC power supply, via the DC/AC converter, for heating the susceptor of the aerosol-generating article when the aerosol-generating article is received by the inductive heating device, the supply of power being provided in a plurality of pulses separated by time intervals, the pulses comprising two or more heating pulses and one or more probing pulses between successive heating pulses; and controlling a duration of a time interval between the successive heating pulses based on the one or more measurements of the current supplied from the DC power supply in one or more of the one or more probing pulses.

* * * * *